US007140653B2

(12) United States Patent
Kobayashi et al.

(10) Patent No.: US 7,140,653 B2
(45) Date of Patent: Nov. 28, 2006

(54) OUTSIDE HANDLE APPARATUS AND CONNECTOR MECHANISM

(75) Inventors: Norikazu Kobayashi, Chita (JP); Koji Aoki, Nagoya (JP); Koichi Hirota, Takahama (JP); Katsutoshi Fukunaga, Chiryu (JP); Yoshimi Nakatani, Tokyo (JP); Masayuki Ohtsugu, Tokyo (JP); Megumi Nakakura, Tokyo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 185 days.

(21) Appl. No.: 10/765,891

(22) Filed: Jan. 29, 2004

(65) Prior Publication Data

US 2004/0251695 A1 Dec. 16, 2004

(30) Foreign Application Priority Data

Jan. 29, 2003 (JP) ..... 2003-021091

(51) Int. Cl.
*E05B 3/00* (2006.01)

(52) U.S. Cl. ..... 292/348; 292/336.3

(58) Field of Classification Search ..... 292/347, 292/336.3; 70/257, 239
See application file for complete search history.

(56) References Cited

U.S. PATENT DOCUMENTS

| | | | | |
|---|---|---|---|---|
| 6,367,295 | B1 * | 4/2002 | Agostini et al. | 70/257 |
| 6,648,493 | B1 * | 11/2003 | Klein | 362/501 |
| 6,871,887 | B1 * | 3/2005 | Jooss et al. | 292/336.3 |
| 2003/0101781 | A1 * | 6/2003 | Budzynski et al. | 70/239 |

FOREIGN PATENT DOCUMENTS

| | | |
|---|---|---|
| EP | 1108835 A2 | 6/2001 |
| JP | 2002-30844 | 1/2002 |

* cited by examiner

*Primary Examiner*—Gary Estremsky
(74) *Attorney, Agent, or Firm*—Buchanan Ingersoll & Rooney PC

(57) ABSTRACT

A vehicle door outside handle apparatus includes a handle frame fixed to a vehicle door, a handle portion supported on the handle frame, at least one electrical component housed in the handle portion, a handle-side connected portion provided at the handle portion and electrically connected to the at least one electrical component housed in the handle portion, and a frame-side connected portion provided at the handle frame. The frame-side connected portion is adapted to be engaged with the handle-side connected portion. The frame-side connected portion can be then electrically connected with the handle-side connected portion.

9 Claims, 17 Drawing Sheets

OUTSIDE HANDLE APPARATUS AND CONNECTOR MECHANISM

CROSS REFERENCE TO RELATED APPLICATIONS

This application is based on and claims priority under 35 U.S.C. § 119 with respect to Japanese Patent Application 2003-021091, filed on Jan. 29, 2003, the entire content of which is incorporated herein by reference.

FIELD OF THE INVENTION

This invention generally relates to an outside handle apparatus and a connector mechanism.

BACKGROUND

Recent developments have lead to a vehicle door that is provided with various types of systems for enhancing convenience for opening/closing the vehicle door, such as an electrically driven door locking system (e.g., an E-latch system) and a wireless remote controlled door locking system (e.g., a smart entry system). An outside door handle apparatus of each type of system is provided with a handle portion that is attached at an outer portion of the vehicle door and houses various types of electrical parts. Various methods have been employed in order to electrically connect these electrical parts housed in the handle portion with the vehicle.

For example, a door opening/closing system is disclosed in Japanese Patent Laid-Open Publication No. 2002-30844. According to the reference, various electrical components in a handle portion are electrically connected to a vehicle by use of a connector and a harness or an electrical signal wire. However, when the electrical parts are electrically connected with the harness or the electrical signal wire at the vehicle side after assembling the handle portion at the vehicle door, electrical connection has to be performed in a space in which the vehicle door was assembled. This may cause increase of the hours need for assembling. Further, the system is provided with the harness. Therefore, it requires considering unpreferable touch between the harness and an adjacent door glass. This may cause increase of hours needed for designing the door placement.

In order to enhance assembling performance of the handle portion at the vehicle door, an outside handle apparatus disclosed in EP Application Publication 1108835 is provided with a handle portion integrated with a connector mechanism. According to the reference, an electrical signal wire at a handle side can be electrically connected with an electrical signal wire at a vehicle side when the handle portion is inserted or linked to the vehicle door. However, in order to achieve the aforementioned electrical connection, the handle portion is required to be a fixed type. This may shadow constrain of versatility.

A need thus exists for providing an improved outside handle apparatus and a connector mechanism, both of which are capable of enhancing assembling performance of the handle portion at the vehicle door without limiting versatility of the handle portion.

SUMMARY OF THE INVENTION

According to an aspect of the present invention, a vehicle door outside handle apparatus includes a handle frame fixed to a vehicle door, a handle portion supported on the handle frame to be accessible from an outside of the vehicle door, at least one electrical component housed in the handle portion, a handle-side connected portion provided at the handle portion and electrically connected to the at least one electrical component housed in the handle portion, and a frame-side connected portion provided at the handle frame. The frame-side connected portion is adapted to be engaged with the handle-side connected portion. The frame-side connected portion can be then electrically connected with the handle-side connected portion.

It is preferable that the frame-side connected portion is adapted to come in contact with the handle-side connected portion to rotate or pivot the frame-side connected portion. Alternatively, it is still preferable that the handle-side connected portion is adapted to come in contact with the frame-side connected portion to rotate or pivot the handle-side connected portion.

According to another aspect of the present invention, the handle-side connected portion and the frame-side connected portion are electrically connected when the handle-side connected portion is mated with the frame-side connected portion. In this case, it is preferable that the handle frame includes means for engaging the frame-side connected portion, and the handle-side connected portion includes means for allowing the handle portion to be assembled at a predetermined position after completely mating the handle-side connected portion with the frame-side connected portion.

According to further aspect of the present invention, a method of electrically connecting a handle portion of a vehicle with a handle frame includes inserting a part of a handle portion into a handle frame which is fixed to a door of a vehicle to mount the handle portion at a position accessible from outside the vehicle. The handle portion includes a first electrical portion, and the handle frame includes a second electrical portion. The first electrical portion of the handle portion is electrically mated with the second electrical portion of the handle frame upon insertion of the part of the handle portion into the handle frame to electrically connect the first electrical portion of the handle portion with the second electrical portion of the handle frame.

It is preferable that the handle portion houses at least one electrical component that is electrically connected to the first electrical portion of the handle portion. The at least one electrical component is electrically connected to the second electrical portion of the handle frame upon insertion of the part of the handle portion into the handle frame.

According to still further aspect of the present invention, a connector mechanism includes a handle frame fixed to a vehicle door, a handle portion supported on the handle frame to be accessible from an outside of the vehicle door, at least one electrical component housed in the handle portion, a handle-side connected portion provided at the handle portion and electrically connected to the at least one electrical component housed in the handle portion, and a frame-side connected portion provided at a handle frame. The frame-side connected portion is adapted to be mated with the handle-side connected portion. The frame-side connected portion can be then electrically connected with the handle-side connected portion. The connector mechanism further includes means for engaging the frame-side connected portion, and means for allowing the handle portion to be assembled at a predetermined position after completely mating the handle-side connected portion with the frame-side connected portion.

It is preferable that the means for allowing the handle portion to be assembled at the predetermined position releases an engaged condition of the frame-side connected portion engaged by the means for engaging.

BRIEF DESCRIPTION OF THE DRAWING FIGURES

The foregoing and additional features and characteristics of the present invention will become more apparent from the following detailed description considered with reference to the accompanying drawing figures, wherein:

FIG. 21(*b*) is another schematic view with a handle frame for explaining the full stroke condition of the handle portion;

FIG. 22(*b*) is another process drawing for explaining the process for assembling the connector to the connector holder attached to the handle frame.

DETAILED DESCRIPTION

Figure 7:
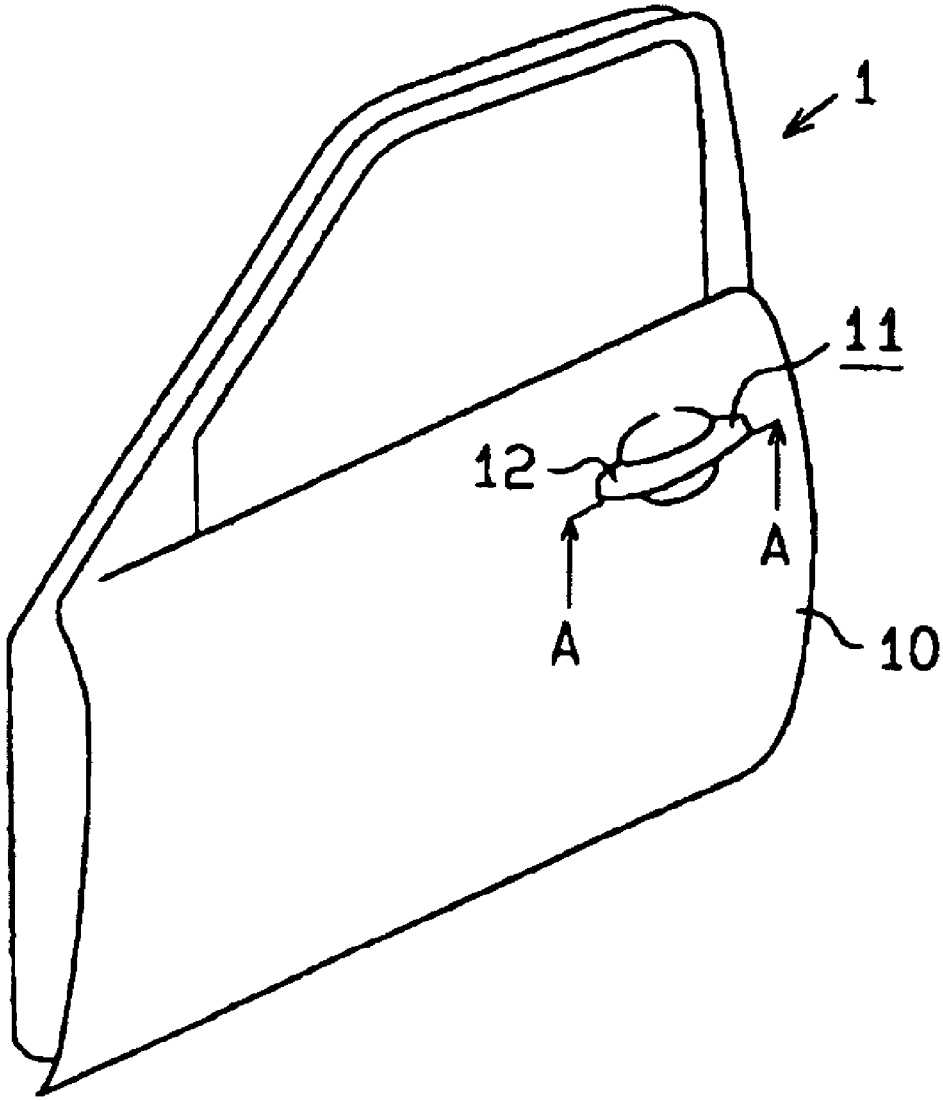
FIG. 7 is a perspective view illustrating a vehicle door according to the first embodiment of the present invention.

As illustrated in FIG. 7, an outside handle 11 according to a first embodiment of the present invention is mounted at a vehicle door 1. More particularly, an outside handle 11 is mounted at a vehicle rearward portion of a door outer panel 10 that defines an outer shape of the vehicle door 1. The door outer panel 10 is provided with a handle portion 12 outwardly upstanding therefrom. The handle portion 12 is gripped by a user upon manually opening or closing the vehicle door 1.

Figure 4:
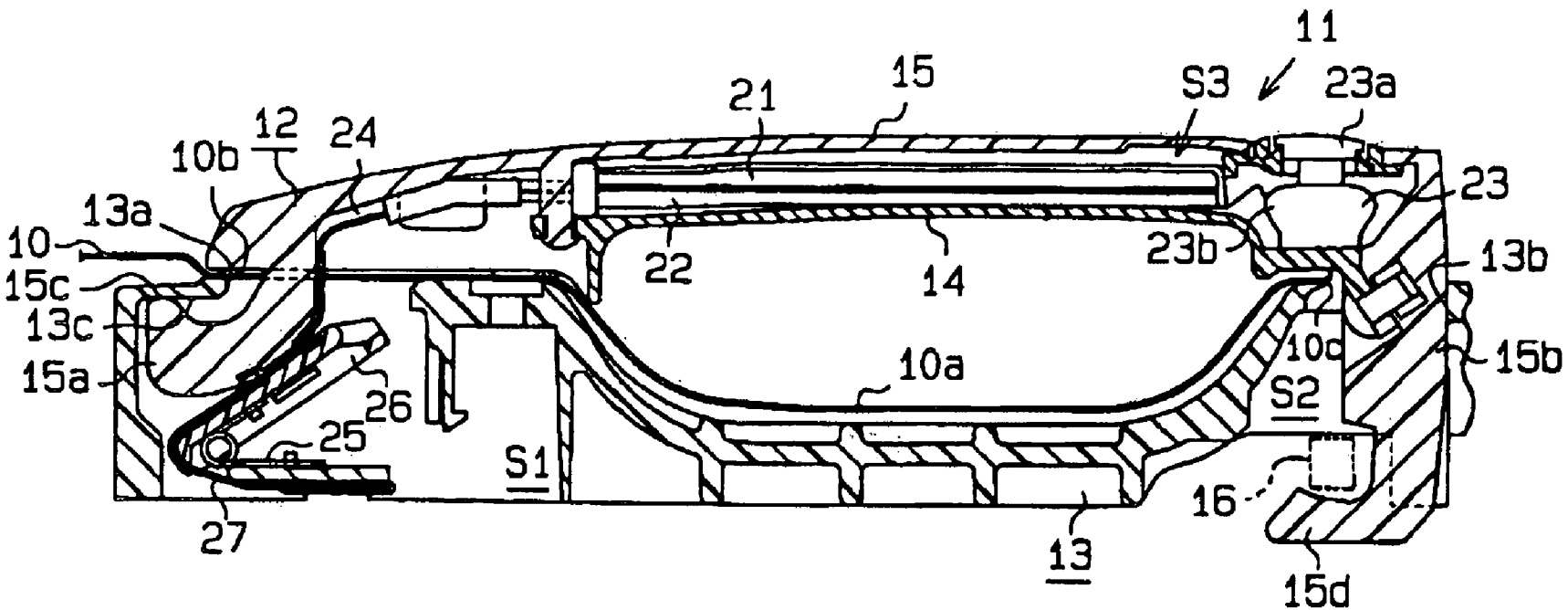
FIG. 4 is a cross sectional view illustrating an entire structure of the outside handle taken along a line A—A in FIG. 7.

As illustrated in FIG. 4, the outside handle 11 includes the handle portion 12 and a handle frame 13. The handle portion 12 is arranged on the exterior side of the door outer panel 10 while the handle frame 13 is arranged on the interior side of the door outer panel 10. The handle frame 13 is fixed to the door outer panel 10. The handle portion 12 is mounted on the handle frame 13, with the door outer panel 10 interposed between the handle portion 12 and the handle frame 13. The handle portion 12 can be rotated relative to the handle frame 13 with a predetermined rotational range.

More particularly, the door outer panel 10 has a curved portion 10*a* curved towards the vehicle inside, i.e., in a direction for extending a distance relative to the handle portion 12. The door outer panel 10 includes panel-side handle inserting openings 10*b* and 10*c* at both sides thereof, i.e., left and right sides in FIG. 4, so as to insert an arm portion of the handle portion 12 thereto. The handle frame 13 can be made of resin material and is defined to have an approximately rectangular cylindrical shape with a seating rim. Further, the handle frame 13 is curved substantially along the curved portion 10*a* of the door outer panel 10. The handle frame 13 includes frame-side handle inserting openings 13*a* and 13*b* at portions corresponding to the respective panel-side handle inserting openings 10*b* and 10*c*. The handle frame 13 defines a first inner space S1 and a second inner space S2 corresponding to the frame-side handle inserting openings 13*a* and 13*b*, respectively.

In the meantime, the handle portion 12 includes a handle base 14 and a handle cover 15 covering the handle base 14. The handle base 14 and the handle cover 15 can be resin made members and define an outer shape of the handle portion 12. The handle cover 15 is integrally provided with a hinge arm portion 15*a* at one side thereof, i.e., at a vehicle forward side illustrated at left side in FIG. 4, and is also integrally provided with a stroke arm portion 15*b* at the other side thereof, i.e., at a vehicle rearward side illustrated at right side in FIG. 4.

The hinge arm portion 15*a* is inserted into the handle-side handle inserting opening 10*b* and the frame-side handle inserting opening 13*a*. A projection 1*c* at a tip end of the hinge arm portion 15*a* can come in contact with a lid portion 13*c* of the handle frame 13. The frame-side handle opening is actually defined at the lid portion 13*c*. The handle portion 12 is rotatably connected to the handle frame 13 with a fulcrum of a contact portion between the projection 15*c* and the lid portion 13*c*. In the meantime, the stroke arm portion 15 is inserted into the handle-side handle inserting opening 10*c* and the frame-side handle inserting opening 13*b*. A bent portion 15*d* at a tip end of the stroke arm portion 15*b* can be engaged with a known bell crank 16 such that the stroke arm portion 15*b* can be moved or pivoted within a predetermined angle. As described above, the handle portion 12 can be rotatably linked to the handle frame 13 about the hinge arm portion 15*a*, i.e. the projection 15*c*, within a turning range allowed by the engagement of the bent portion 15*d* and the bell crank 16.

The handle portion 12 includes an inner space S3 substantially blocked by the handle base 14 and the handle cover 15. The inner space S3 houses a transmitting antenna 21, a door unlocking sensor 22, and a door locking switch 23, all of which are types of electrical associated parts for enhancing convenience for opening or closing the vehicle door 1.

The transmitting antenna 21 transmits a signal for requiring identification of a portable radio unit carried by a user trying to open or close the vehicle door 1, thereby identifying that the portable radio unit carried by the user is approaching the vehicle. The door unlocking sensor 22 detects the condition of the handle portion 12, such as how much the user has touched the handle portion 12, whether the user has touched the handle portion 12, or whether the user is approaching the handle portion 12. The door locking switch 23 is manually operated for the door lock. More particularly, the door locking switch 23 is provided with a switch button 23*a* mounted in the handle cover 15 and a detecting portion 23*b* arranged at a corresponding portion of the switch button 23*a* in the handle base 14. The detecting portion 23*b* detects the pushing operation of the switch button 23*a* such that the vehicle door 1 can be locked. Respective electrical signal wires of the transmitting antenna 21, the door unlocking sensor 22, and the door locking switch 23 meet together and are connected to a single flexible flat cable 24, i.e., an FFC 24, arranged at a side of the hinge arm portion 15*a* outside the inner space S3. The FFC 24 defines an electrical signal wire at the side of the handle portion 12 and is guided out along the hinge arm portion 15*a*. The FFC 24 can be electrically connected to electrical signal wires at a side of the vehicle, i.e., at a side of the handle frame 13.

Figure 1:
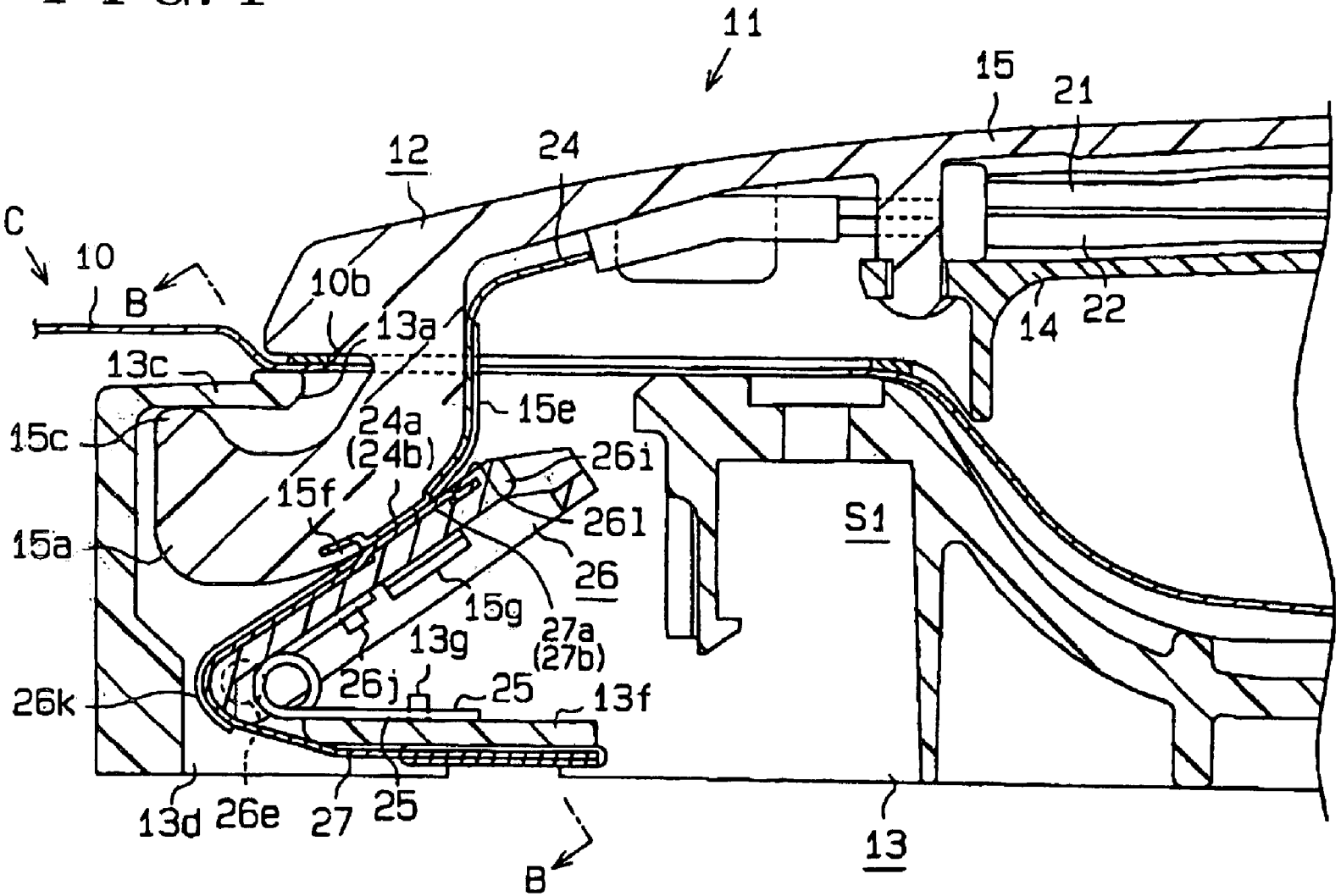
FIG. 1 is a cross sectional view illustrating an outside handle according to a first embodiment of the present invention.

The following description describes one example of an electrically connected condition between the FFC 24 and the vehicle, i.e., the handle frame 13. As illustrated in FIG. 1, one side of the hinge arm portion 15*a* facing the stroke arm portion 15*b* is curved. The curved portion has a guiding claw 15*e* at a base end side thereof and a supporting portion 15*f* at a tip end side thereof. The FFC 24 has a handle-side connected portion 24*b* (i.e. a first electrical portion) between the guiding claw 15*e* and the supporting portion 15*f*. The handle-side connected portion 24*b* of the FFC 24 has plural leads 24*a* (i.e. a first lead) that are uncovered or exposed. According to the first embodiment of the present invention, there are at least four leads 24*a*. Both sides of the FFC 24 is supported by the guiding claw 15*e* and the FFC 24 is guided out along the hinge arm portion 51*a*. Further, an end of each uncovered lead 24*a* is inserted and supported by the supporting portion 15*f*.

Figure 2:
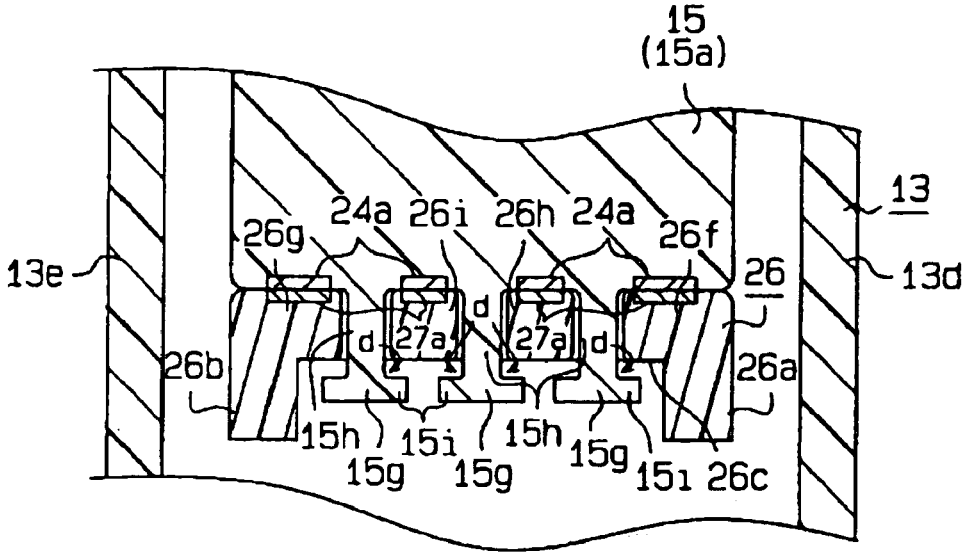
FIG. 2 is a cross sectional view taken along a line B—B in FIG. 1.

As illustrated in FIG. 2, the hinge arm portion 15*a* is integrally provided with plural engaging members 15*g* that are respectively arranged between the respective leads 24*a*. According to the first embodiment of the present invention, there are the at least three engaging members 15*g* arranged between the respective leads 24*a*. Each engaging member 15*g* includes a bridgewall 15*h* extending approximately at right angels from the hinge arm portion 15*a*, and an engaging portion 15*i* projecting in a lateral direction at a tip end of the bridgewall 15*h*, wherein each engaging member 15*g* has an approximately T-shaped cross section.

Figure 3:
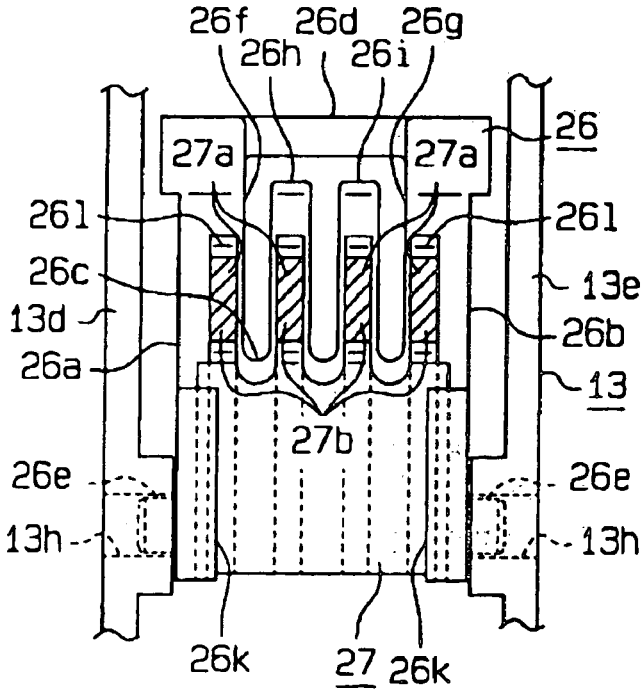
FIG. 3 is a plan view viewed in an arrow direction C in FIG. 1.

As illustrated in FIG. 1, there is a plate-shaped supporting wall portion 13*f* provided at a bottom side of the handle frame 13 in the first inner space S1. The supporting wall portion 13*f* extends between facing side wall portions 13*d* and 13*e*. The supporting wall portion 13*f* mounts a supporting piece 13*g* thereon, which supports one end of a torsion coil spring 25 (i.e. means for biasing). Therefore, the one end of the torsion coil spring 25 is fixed to the handle frame 13. Further, as illustrated in FIG. 3, bearing portions 13*h* are defined in the respective side wall portions 13*d* and 13*e* opening in the lateral direction.

The handle frame 13 supports a connecting base 26 made of resin material. As illustrated in FIG. 3, facing side wall portions 26*a* and 26*b* are connected by a connecting wall portion 26*c* at a base end side of the connecting base 26 and the other connecting wall portion 26*d* at a tip end side thereof. Shaft portions 26*e* integrally and outwardly project from the base end side of the respective side wall portions 26*a* and 26*b*. The shaft portions 26*e* project outwardly from portions of the connecting base 26 corresponding to the bearing portions 13*h*. Therefore, the connecting base 26 can be rotated relative to the handle frame 13 with the shaft portions 26*e* inserted into the bearing portions 13*h*.

The connecting base 26 supports the other end of the torsion coil spring 25. The connecting base 26 includes engaging wall portions 26*f* and 26*g*, which are connected to the connecting wall portion 26*c*, the side wall portions 26*a* and 26*b*. The engaging wall portion 26*f* projects from the side wall portion 26*a* and the engaged wall portion 26*g* projects from the side wall portion 26*b*. The connecting base 26 further includes projecting wall portions 26*h* and 26*i*, both of which extend in a comb-shaped manner between the engaging wall portions 26*f* and 26*g*. The connecting wall portion 26*c* has a supporting piece 26*j* (shown in FIG. 1) at an approximately central portion of the projecting wall portions 26*h* and 26*i*. The other end of the torsion coil spring 25 is supported by the supporting piece 26*j*. Therefore, the connecting base 26 can be biased by the torsion coil spring 25 and rotated around the shaft portions 26*e* in a direction to be away from the supporting wall portion 13*f*, i.e., towards the hinge arm portion 15*a*, i.e., in a counterclockwise direction in FIG. 1. The rotation of the connecting base 26 is restrained at a predetermined position by a non-illustrated stopper defined at the handle frame 13 such that the connecting base 26 can be prevented from being excessively biased in the aforementioned direction. As illustrated in FIG. 2, the bridgewall 15*h* of each engaging member 15*g* is arranged between the engaging wall portion 26*f* and the projecting wall portions 26*h*, between the projecting wall portions 26*h* and 26*i*, and between the projecting wall portion 26*i* and the engaging wall portion 26*g*. Each engaging member 15*g* is prevented from being dropped off in favor of the engaging portion 15*i*. As described above, displacement between the hinge arm portion 15*a* and the connecting base 26 in a right and left direction in FIG. 2, can be substantially restrained. Further, the hinge arm portion 15*a* and the connecting base 26 can be relatively oscillated along the engaging wall portions 26*f*, 26*g*, and the projecting wall portions 26*h*, 26*i*. The hinge arm portion 15*a* can be then allowed to rotate without displacing relative to the connecting base 26 in the right and left direction in FIG. 2.

A frame-side FFC 27 is provided at the connecting base 26, which can be electrically connected to the FFC 24. As illustrated in FIG. 1, the FFC 27 extends towards the base end side of the connecting base 26 along the connecting base 26. One end side of the frame-side FFC 27 is guided along the supporting wall portion 13*f* and is arranged at an opening side of the handle frame 13. The frame-side FFC 27 defines an electrical signal wire at the vehicle side, i.e., at the handle frame 13 side. Further, the frame-side FFC 27 can be electrically connected to the electrical signal wire at the vehicle side.

More particularly, as illustrated in FIG. 3, each side wall portion 26*a* and 26*b* has a guiding portion 26*k* extending from the base end portion to an intermediate portion. A supporting portion 26*l* is defined at each tip end portion of the engaging wall portions 26*f*, 26*g*, and the projecting wall portions 26*h*, 26*i*. The frame-side FFC 27 has a frame-side connected portion 27*b* (i.e. a second electrical portion) between the guiding portions 26*k* and the supporting portions 261. The frame-side connected portion 27*b* of the FFC 27 has plural leads 27*a* (i.e. a second lead) that are uncovered or exposed. According to the first embodiment of the present invention, there are the at least four leads 27*a*. As described above, a tip end of each lead 27*a* is inserted and supported by each supporting portion 261, and both sides of the FFC 27 are supported by the guiding portions 26*k*. The FFC 27 is then guided to the opening side of the handle frame 13 along the connecting base 26 and the supporting wall portion 13*f*.

Figure 5:
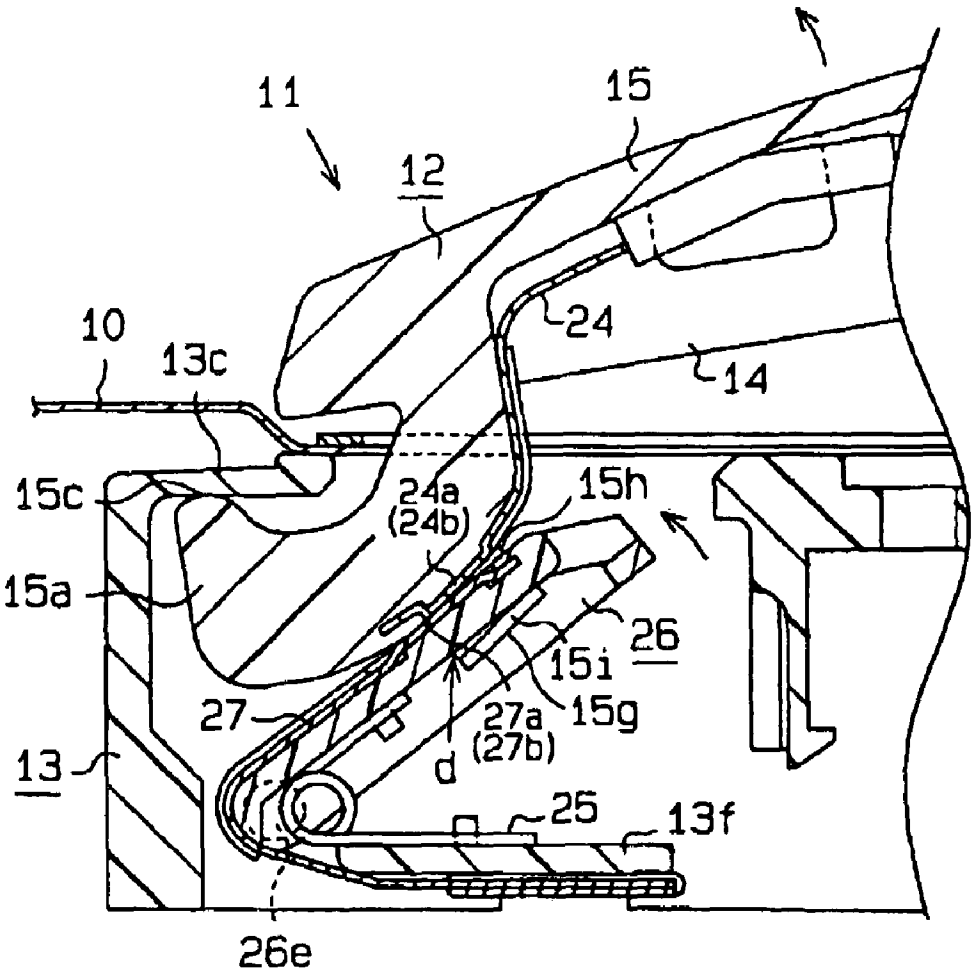
FIG. 5 is a cross sectional view illustrating a condition of a handle portion rotated at a maximum rotating amount within an allowable range according to the first embodiment.

The frame-side connected portion 27*b* of the FFC 27 is pressed to the handle-side connected portion 24*b* of the FFC 24 along the biasing force of the torsion coil spring 25. Therefore, the frame-side connected portion 27*b* can be electrically connected to the handle-side connected portion 24*b* by the biasing force of the torsion coil spring 25. When the handle portion 12 is rotated from a normal condition (i.e. a predetermined position) with no applied load in FIG. 1 to a full-stroke condition illustrated in FIG. 5, in which the handle 12 is rotated at a maximum rotation angle within the allowable range, the connecting base 26 is rotated along movement of the hinge arm portion 15*a* by the biasing force of the torsion coil spring 25. Therefore, the frame-side connected portion 27*b* can be also reliably electrically connected to the handle-side connected portion 24*b* by the biasing force of the torsion coil spring 25. Especially, the handle-side connected portion 24*b* is an arched structure, thereby capable of avoiding interference between the handle-side connected portion 24*b* and the connecting base 26 and further capable of avoiding loose connection with the frame-side connected portion 27*b*. In this case, the hinge arm portion 15*a* and the connecting base 26 can be substantially restrained from being displaced in the lateral direction by the engaging members 15*g* respectively arranged between the engaging wall portion 26*f* and the projecting wall portion 26*h*, between the projecting wall portions 26*h* and 26*i*, and between the projecting wall portion 26*i* and the engaging wall portion 26*g*. Therefore, the handle-side connected portion 24*b* and the frame-side connected portion 27*b* can be prevented from being displaced in the lateral direction, thereby enabling to avoid loose connection therebetween. As illustrated in FIG. 2, there is predetermined clearances d respectively defined from the engaging portion 15*i* relative to the engaged wall portions 26*f*, 26*g*, and the projecting wall portions 26*h*, 26*i*. Therefore, the smooth movement of the connecting base 26 can be achieved along with the movement of the hinge arm portion 15*a*. When the handle portion 12 is returned from the full stroke condition to the normal condition illustrated in FIG. 1, the above electrical connection can be achieved in the same manner.

Figure 6:
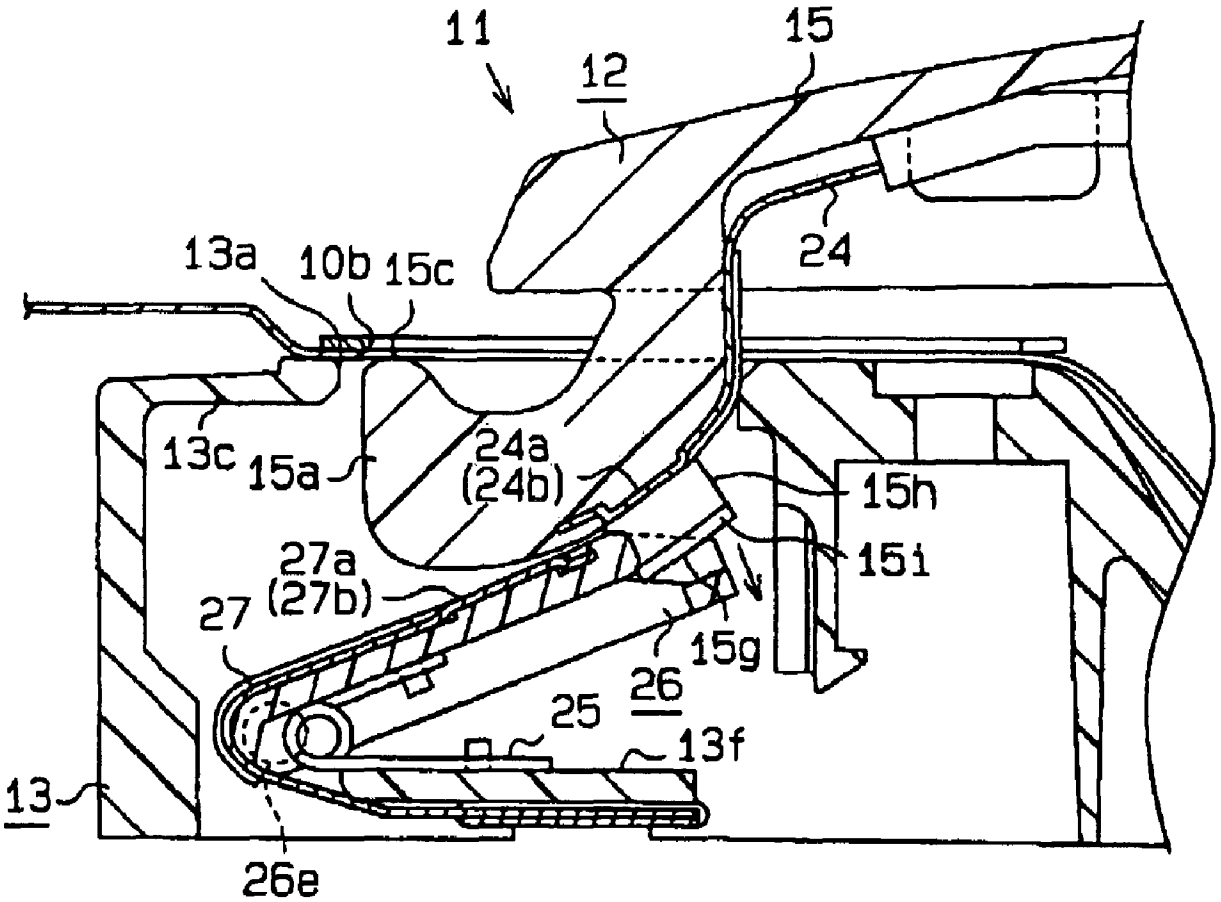
FIG. 6 is a cross sectional view illustrating a method of assembling the handle portion to a handle frame according to the first embodiment of the present invention.

The following description will describe an example of methods of assembling the handle portion 12 to the handle frame 13. As illustrated in FIG. 6, the whole hinge arm portion 15*a* including the projection 15*c* is inserted into the first inner space S1 of the handle frame 13 through the handle inserting openings 10*b* and 13*a*. The connecting base 26 is pushed down towards the supporting wall portion 13*f*, i.e., in a clockwise direction in FIG. 1, around the shaft portions 26*e* by the hinge arm portion 15*a* against the biasing force of the torsion coil spring 25. At this point, a tip end of each engaging member 15*g* is arranged at a tip end of each of the engaging wall portions 26*f*, 26*g*, and the projecting wall portions 26*h*, 26*i*, without causing any interferences between the: engaging portions 15*i*. Under this condition of the handle portion 12, the hinge arm portion 15*a* is inserted towards the lid portion 13*c*, and the hinge arm portion 15*a* is slidably moved on the connecting base 26. The hinge arm portion 15*a* is then further moved with the bridgewalls 15*h* guided by the engaging wall portions 26*f*, 26*g*, and the projecting wall portions 26*h*, 26*i*.

As described above, upon assembling the handle portion 12 to the handle frame 13, the hinge arm portion 15*a* and the connecting base 26 can be restrained from being displaced in the lateral direction by the engaging members 15*g* respectively arranged between the engaging wall portion 26*f* and the projecting wall portion 26*h*, between the projecting wall portions 26*h* and 26*i*, and between the projecting wall portions 26*i* and the engaging wall portion 26*g*. The hinge arm 15*a* is then positioned so as to electrically connect the handle-side connected portion 24*b* with the frame-side connected portion 27*b*. Further, upon this assembling process, the clearance d allows the relative displacement between the hinge arm portion 15*a* and the connecting base 26, thereby enabling to enhance the assembling performance of the hinge arm portion 15*a* to the connecting base 26.

As described above, according to the first embodiment of the present invention, following effects can be obtained as non-limiting examples.

(1) The frame-side connected portion 27*b*, which can be electrically connected to the handle-side connected portion 24*b* of the hinge arm-portion 15*a*, is provided at the side of the handle frame 13 so as to be moved or pivoted. Therefore, when the handle portion 12 is assembled to the handle frame 13 or is supported thereby, the frame-side connected portion 27*b* or the connecting base 26 can be shifted within the oscillating range and be pressed to the handle-side connected portion 24*b*. In this case, the handle-side connected portion 24*b* can be electrically connected to the frame-side connected portion 27*b*. Further, the assembling performance of the handle portion 12 to the handle frame 13 can be enhanced. What is more, even if the handle portion 12 is a movable type, the aforementioned electrical connection can be achieved within the above oscillating range, according to the first embodiment of the present invention, thereby enabling to enhance versatility of the handle portion 12.

The frame-side connected portion 27*b* can be electrically connected to the handle-side connected portion 24*b* in an easy way such as pressing. Regardless of the normal condition or the full stroke condition of the handle portion 12, a contact pressure can be ensured by the pressing them. Therefore, the electrical connection therebetween can be reliably ensured. That is, the connecting base 26 is rotated along with the rotational operation of the handle portion 12.

Therefore, the contact condition between the handle-side connected portion 24*b* and the frame-side connected portion 27*b* can be maintained, thereby enabling to ensure electrical performance.

(2) Each electrical connection between one of the leads 24*a* and one of the leads 27*a* can be separated form the adjacent electrical connection therebetween by the engaging member 15*g*. Therefore, even if the vehicle door 1 is taken into water for example, electrical leakage between each adjacent electrical connection can be avoided, thereby enabling to assure electrical performance.

(3) The handle-side connected portion 24*b* to be electrically connected to the vehicle side is provided substantially integrally with the hinge arm portion 15*a*. Therefore, upon assembling the handle portion 12 to the vehicle door 1, inserting performance of the handle-side connected portion 24*b* to the door outer panel 10 can be improved. On the other hand, if a connector such as the handle-side connected portion 24*b* is not substantially integrated with the hinge arm portion 15*a*, the connector is required to be inserted additionally.

(4) The handle-side connected portion 24*b* is provided at the hinge arm portion 15*a* that is positioned at the side of rotation center of the handle portion 12. Therefore, compared with the handle-side connected portion 24*b* provided at the side of the stroke arm portion 15*b*, the handle-side connected portion 24*b* does not need to be widely moved.

Further, upon designing the outside door handle, extra length of a harness, which may be necessarily considered in light of rotation of the handle portion 12, does not have to be considered. Further, interference between the harness and adjacent components thereof, which may be necessarily considered in light of rotational displacement of the harness, does not have to be considered. Therefore, designing hours can be effectively reduced.

An outside door handle according to a second embodiment of the present invention is described hereinbelow with reference to FIGS. 8 through 12. According to the second embodiment of the present invention, a connecting base corresponding to the connecting base 26 according to the first embodiment of the present invention is provided at a side of a hinge arm portion of a handle cover. However, the other structure of the outside door handle according to the second embodiment is substantially the same as the structure according to the first embodiment, wherein some of the description thereof will be omitted therefore.

Figure 8:
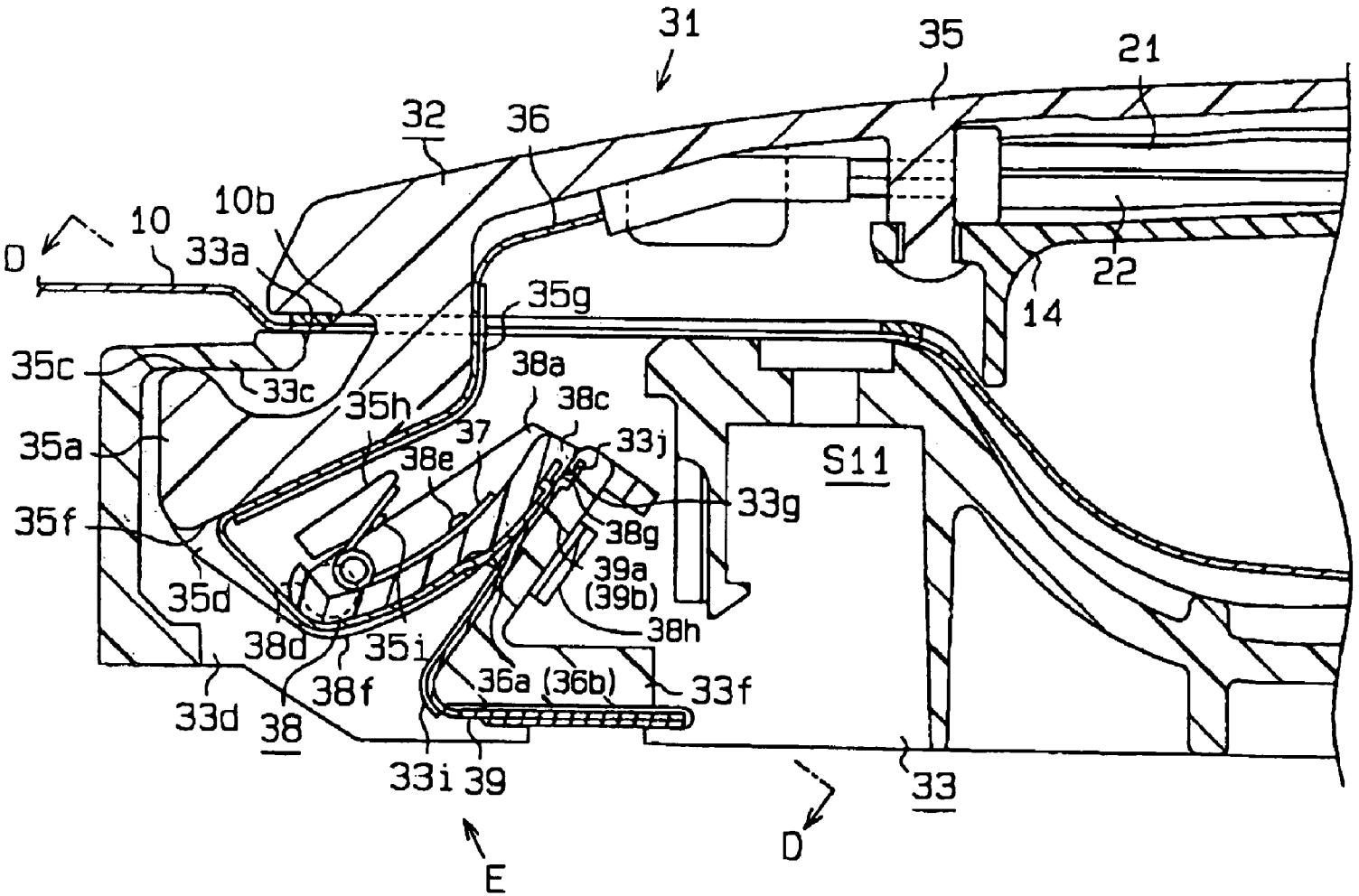
FIG. 8 is a cross sectional view illustrating an outside handle according to a second embodiment of the present invention.

As illustrated in FIG. 8, an outside handle 31 includes a handle portion 32 and a handle frame 33. The handle portion 32 is arranged on the exterior side of the door outer panel 10 while the handle frame 13 is arranged on the interior side of the door outer panel 10. The handle frame 33 is fixed to the door outer panel 10 in the same manner as the first embodiment of the present invention. The handle portion 32 is mounted on the handle frame 33, with the door outer panel 10 interposed between the handle portion 32 and the handle frame 33. The handle portion 32 can be rotated relative to the handle frame 33 within a predetermined rotational range.

The handle frame 33 can be made of resin material and is defined to have an approximately rectangular cylindrical shape with a seating rim. The handle frame 33 includes a frame-side handle inserting opening 33*a* at a portion corresponding to the panel-side handle inserting opening 10*b*. The handle frame 33 defines a first inner space S11 corresponding to the frame-side handle inserting opening 33*a*.

In the meantime, the handle portion 32 includes the handle base 14 and a handle cover 35, both of which can be resin made. The handle cover 35 is substantially integrally provided with a hinge arm portion 35*a* at one side thereof, i.e., at a vehicle forward side illustrated at left side in FIG. 8.

The hinge arm portion 35*a* is inserted into the panel-side handle inserting opening 10*b* and the frame-side handle inserting opening 33*a*. A projection 35*c* at a tip end of the hinge arm portion 35*a* can come in contact with a lid portion 33*c* of the handle frame 33. The handle portion 32, i.e., the handle cover 35 is rotatably connected to the handle frame 33 with a fulcrum of a contact portion between the projection 35*c* and the lid portion 33*c*.

According to the second embodiment of the present invention, the respective electrical signal wires of the transmitting antenna 21, the door unlocking sensor 22, and the door locking switch 23 meet together and are connected to a single flexible flat cable 36, i.e., an FFC 36, arranged at a side of the hinge arm portion 35*a*. The FFC 36 defines an electrical signal wire at the side of the handle portion 32 and is guided out along the hinge arm portion 35*a*. The FFC 36 can be electrically connected to an electrical signal wire at a side of the vehicle, i.e., at a side of the handle frame 33.

The following description describes one example of an electrically connected conditions between the FFC 36 and the vehicle, i.e., the handle frame 33. The hinge arm portion 35*a* includes side wall portions 35*d* and 35*e* extending towards a bottom portion side of the handle frame 33, i.e., towards a bottom side in FIG. 8, and a lid portion 35*f* connecting the side wall portions 35*d* and 35*e*. Guiding claws 35*g* are provided the respective side wall portions 35*d* and 35*e* along the lid portion 35*f* and project towards the respective side wall portions 35*d* and 35*e*. The FFC 36 is guided out along the hinge arm 35*a*, i.e., along the lid portion 35*f*, with both sides of the FFC 36 being supported by the guiding claws 35*g*.

Figure 9:
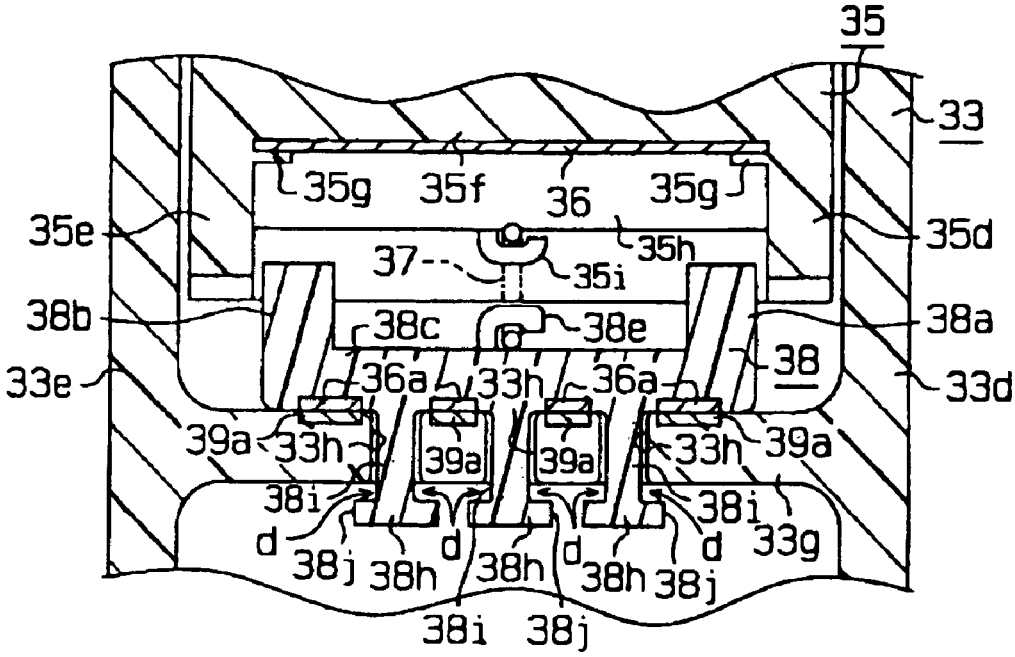
FIG. 9 is a cross sectional view taken along a line D—D in FIG. 8.
Figure 10:
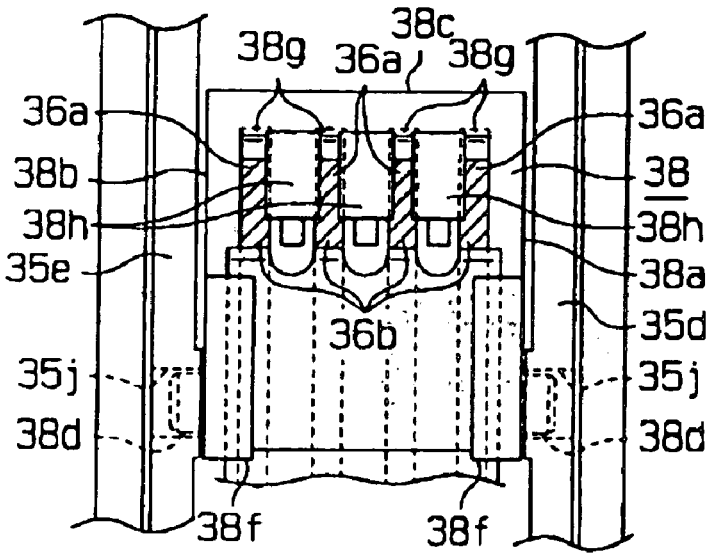
FIG. 10 is a plan view viewed in an arrow direction E in FIG. 8.
Figure 11:
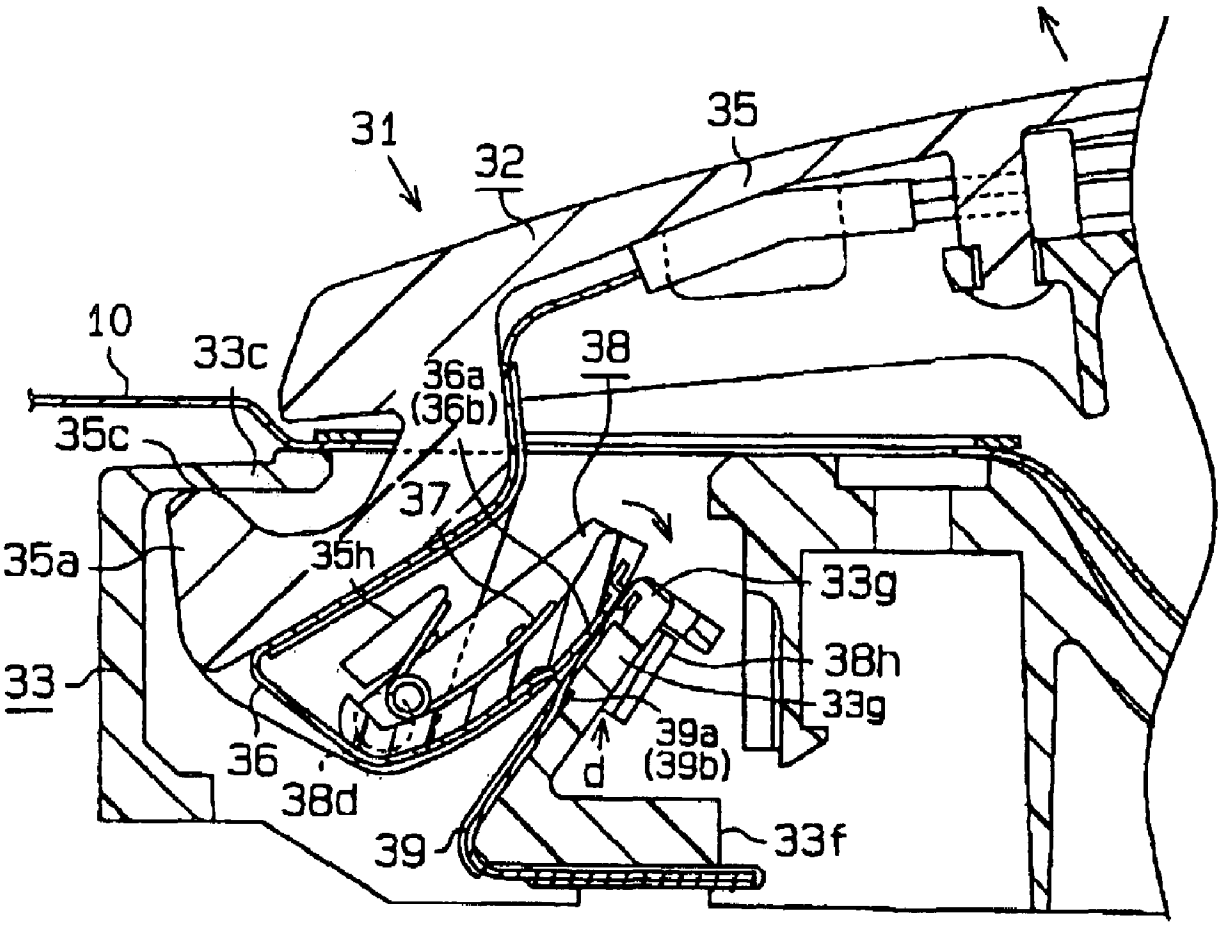
FIG. 11 is a cross sectional view illustrating a condition of a handle portion rotated at a maximum rotating amount within an allowable range according to the second embodiment.

As illustrated in FIG. 9, a plate-shaped supporting wall portion 35*h* extends between approximately intermediate portions of the side wall portions 35*d* and 35*e*. The supporting wall portion 35*h* has a supporting piece 35*i* that supports one end of a torsion coil spring 37 (i.e. means for biasing). Therefore, the one end of the torsion coil spring 37 is fixed to the hinge arm portion 35*a*. Further, as illustrated in FIG. 10, bearing portions 35*j* are defined in the respective side wall portions 35*d* and 35*e* opening in a width direction near the supporting wall portion 35*h*.

The hinge arm portion 35*a* supports a connecting base 38 made of resin material. As illustrated in FIG. 10, facing side wall portions 38*a* and 38*b* are connected by a plate-shaped connecting wall portion 38*c*. Shaft portions 38*d* are integrally provided at a base end side of the respective side wall portions 38*a* and 38*b*. The shaft portions 38*d* project outwardly from portions of the connecting base 38 corresponding to the bearing portions 35*j*. Therefore, the connecting base 38 can be rotatably linked to the hinge arm portion 35*a* with the shaft portions 35*j* inserted into the bearing portions 38*d*.

The connecting base 38 supports the other end of the torsion coil spring 37. The connecting base 38 has a supporting piece 38*e* (shown in FIGS. 8 and 9) at an approximately central portion of the connecting wall portion 38*c*. More particularly, the other end of the torsion coil spring 37 is supported by the supporting piece 38*e*. Therefore, the connecting base 38 can be biased by the torsion coil spring 37 and rotated around the shaft portions 38*d* in a direction to be away from the supporting wall portion 35*h*, i.e., towards an opposite side to the hinge arm portion 15*e*, i.e., in a clockwise direction in FIG. 8. The rotation of the connecting base 38 is restrained at a predetermined position by a non-illustrated stopper such that the connecting base 26 can be prevented from being excessively biased in the aforementioned direction.

As illustrated in FIG. 8, bottom surfaces of the side wall portions 38*a*, 38*b*, and the connecting wall portion 38*c* are curved. A guiding claw 38*f* is defined at a base end side of each side wall portion 38*a* and 38*b*, and supporting claws 38*g* are defined at a tip end side of the connecting wall portion 38*c*. The FFC 36 has a handle-side connected portion 36*b* (i.e. a first electrical portion) between the guiding claws 38*f* and the supporting claws 38*g*. The handle-side connected portion 36*b* of the FFC 36 has plural leads 36*a* (i.e. a first lead) that are uncovered or exposed. According to the second embodiment of the present invention, there are the at least four leads 36*a*. Both sides of the FFC 36 are supported by the guiding claws 38*f* and the FFC 36 is guided out along the connecting base 38. Further, an end of each uncovered lead 36*a* is inserted and supported by the supporting claw 38*g*.

As illustrated in FIG. 9, the connecting wall portion 38*c* of the connecting base 38 is integrally provided with plural engaging members 38*h* that are respectively arranged between the respective leads 36*a*. According to the second embodiment of the present invention, there are the at least three engaging members 38*h* arranged between the respective leads 36*a*. Each engaging member 38*h* includes a bridgewall 38*i* extending approximately at right angels from the connecting base 38, and an engaging portion 38*j* projecting in a width direction at a tip end of each bridgewall 38*i*, wherein each engaging member 38*h* has an approximately T-shaped cross, section.

A plate-shaped connecting wall 33*f* is defined at a bottom portion side of the first inner space S11 of the handle frame 33, i.e., at the bottom side in FIG. 8. The connecting wall 33*f* extends between the facing side wall portions 33*d* and 33*e*. As illustrated in FIG. 8, an engaging wall portion 33*g* is continuously defined at a tip end of the connecting wall portion 33*f* and extends with a slope towards the frame-side handle inserting opening 33*a*. As illustrated in FIG. 9, the engaging wall portion 33*g* includes plural engaging grooves 33*h* notched from a tip end side of the engaging wall portion 33*g*. Each engaging groove 33*h* corresponds to each engaging member 38*h*, i.e., corresponds to each bridgewall 38*i*. According to the second embodiment of the present invention, the engaging wall portion 33*g* has the at least three engaging grooves 33*h*. Each bridgewall 38*i* is inserted to the engaging groove 33*h* and is prevented from being dropped off by the engaging portion 38*j*. As described above, the connecting base 38 and the engaging wall portion 33*g* can be restrained from being displaced in the lateral direction, i.e., in the right and left direction in FIG. 9. Further, the connecting base 38 and the engaging wall portion 33*g*, i.e., the handle frame 33 can be relatively moved or pivoted along the engaging grooves 33*h*. Still further, the connecting base 38, i.e., the hinge arm portion 35*a* can be allowed to rotate without being displaced in the lateral direction relative to the engaging grooves 33*h*.

A frame-side FFC 39 is provided at the engaging wall portion 33*g*, which can be electrically connected to the FFC 36. As illustrated in FIG. 8, the FFC 39 extends towards the base end side of the connecting base 38 along the engaging wall portion 33*g*. One end side of the frame-side FFC 39 is guided along the connecting-wall portion 33*f* and is arranged at an opening side of the handle frame 33. The frame-side FFC 39 defines an electrical signal wire at the vehicle side, i.e., at the handle frame 13 side. Further, the frame-side FFC 39 can be electrically connected to the electrical signal wire at the vehicle side.

More particularly, as illustrated in FIG. 8, the engaging wall portion 33*g* has a guiding claw 33*i* extending from the base end portion to an; intermediate portion. Supporting claws 33*j* are defined at a tip end portion of the engaging wall portion 33*g*. According to the second embodiment of the present invention, the engaging wall portion 33*g* is provided with the at least four supporting claws 33*j*. The FFC 39 has a frame-side connected portion 39*b* (i.e. a second electrical portion) between the guiding claws 33*i* and the supporting claws 33*j*. The frame-side connected portion 39*b* of the FFC 39 has plural leads 39*a* (i.e. a third lead) that are uncovered or exposed. According to the second embodiment of the present invention, there are the at least four leads 39*a*. Each tip end of the leads 39*a* of the frame-side FFC 39 is inserted and supported by each supporting claw 33*j*. Further, the frame-side FFC 39 is guided out to the opening side of the handle frame 33 along the engaging wall portion 33*g* and the connecting wall portion 33*f* with both sides of the FFC 39 supported by the guiding claw 33*i*.

The frame-side connected portion 39*b* of the FFC 39 is pressed to the handle-side connected portion 36*b* of the FFC 36 along the biasing force of the torsion coil spring 37. Therefore, the frame-side connected portion 39*b* can be electrically connected to the handle-side connected portion 36*b* by the biasing force of the torsion coil spring 37. When the handle portion 32 is rotated from a normal condition with no applied load in FIG. 8 to a full-stroke condition illustrated in FIG. 11, in which the handle portion 32 was rotated at a maximum rotation angle within the allowable range, the connecting base 38 is rotated by the biasing force of the torsion coil spring 37 along movement of the engaging wall portion 33*g*. Therefore, the frame-side connected portion 39*b* can be reliably electrically connected to the handle-side connected portion 36*b* by the biasing force of the torsion coil spring 37. Especially, the, handle-side connected portion 36*b* is an arched structure, thereby capable of avoiding interference between the handle-side connected portion 36*b* and the engaging wall portion 33*g* and further capable of avoiding loose connection between the handle-side connected portion 36*b* and the frame-side connected portion 39*b*. In this case, the connecting base 38 and the engaging wall portion 33*g* can, be substantially restrained from being displaced in the lateral direction by the engaging members 38*h* inserted into the respective engaging grooves 33*h*. Therefore, the handle-side connected portion 36*b* and the frame-side connected portion 39*b* can be prevented from being displaced in the lateral direction, thereby enabling to avoid loose connection therebetween. As illustrated in FIG. 9, there is a predetermined clearance d between the engaging wall portion 33*g* and each engaging portion 38*j*. Therefore, smooth movement of the connecting base 38 can be achieved along with the movement of the engaging wall portion 33*g*. When the handle portion 32 is returned from connection can be achieved in the same manner.

Figure 12:
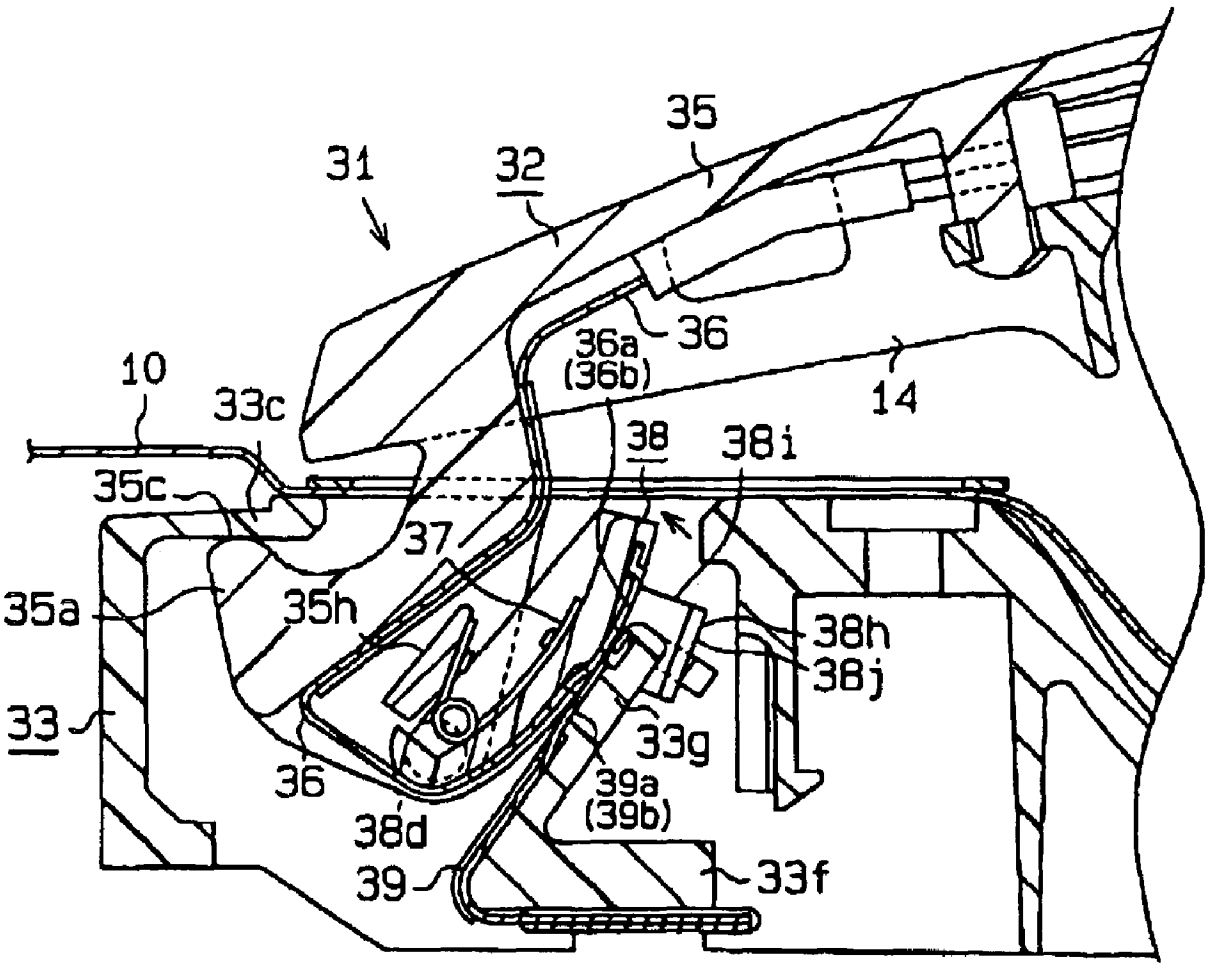
FIG. 12 is a cross sectional view illustrating a method of assembling the handle portion to a handle frame according to the second embodiment of the present invention.

The following description will describe an example of method of assembling the handle portion 32 to the handle frame 33. As illustrated in FIG. 12, the whole hinge arm portion 35*a* already provided with the connecting base 38 is inserted into the first inner space S11 of the handle frame 33 through the handle inserting openings 10*b* and 33*a*. The connecting base 38 is pushed up to approach the hinge arm portion 35*a*, i.e., in a counterclockwise direction in FIG. 8, around the shaft portions 38*d* by the engaging wall portion 33*g* against the biasing force of the torsion coil spring 37. At this point, a tip end of each engaging member 38*h* is arranged at a tip end of each engaging groove 33*h*, without causing any interference with each engaging portion 38*j*. Under this condition of the handle portion 32, the hinge arm portion 35*a* is further inserted towards the lid portion 33*c*, and the connecting base 38 provided at the hinge arm portion 35*a* is slidably moved on the engaging wall portion 33*g*. The connecting base 38 is then moved with the bridgewalls 38*i* guided by the engaging grooves 33*h*.

As described above, also upon assembling the handle portion 32 to the handle frame 33, the connecting base 38 and the engaging wall portion 33*g* can be restrained from being displaced in the right and left direction by the engaging units 38*h* respectively inserted into the engaging grooves 33*h*. The connecting base 38 is eventually positioned so as to electrically connect the handle-side connected portion 36*b* with the frame-side connected portion 39*b*. Further, also upon this assembling process, the clearance d allows the relative displacement between the engaging wall portion 33*g* and the connecting base 38, thereby enabling to enhance the assembling performance of the engaging wall portion 33*g* to the connecting base 38.

As described above, according to the second embodiment of the present invention, following effects can be obtained as non-limiting examples in addition to the effects (3) and (4) according to the first embodiment of the present invention.

(1) The handle-side connected portion 36*b*, which can be electrically connected to the frame-side connected portion 39*b* of the handle frame 33, is provided at the side of the handle portion 32 so as to be moved or rotated. Therefore, when the handle portion 32 is assembled to the handle frame 33 or is supported thereby, the handle side connected portion 36*b* or the connecting base 38 can be shifted within the oscillating range and can be pressed to the frame-side connected portion 39*b*. In this case, the handle-side connected portion 36*b* can be electrically connected to the frame-side connected portion 39*b*. Further, the assembling performance of the handle portion 32 to the handle frame 33 can be enhanced. What is more, even if the handle portion 32 is a movable type, the aforementioned electrical connection can be achieved within the above oscillating range, thereby enabling to enhance versatility of the handle portion 32.

The frame-side connected portion 39*b* can be electrically connected to the handle-side connected portion 36*b* in an easy way such as pressing. Regardless of the normal condition or the full stroke condition of the handle portion 32, a contact pressure can be ensured by the pressing therebetween. Therefore, the electrical connection therebetween can be reliably achieved. That is, the connecting base 38 is rotated along with the rotational operation of the handle portion 32. Therefore, the contact condition between the handle-side connected portion 36*b* and the frame-side connected portion 39*b* can be maintained, thereby enabling to ensure electrical performance.

(2) Each electrical connection between one of the leads 36*a* and one of the leads 39*a* can be separated form the adjacent electrical connection therebetween by the engaging member 38*h*. Therefore, even if the vehicle door 1 is taken into water for example, electrical leakage between each adjacent electrical connection can be prevented, thereby enabling to assure electrical performance.

An outside door handle apparatus according to a third embodiment of the present invention will be described with reference to FIGS. 13 through 19. According to the first and second embodiments of the present invention, electrical connection is achieved by pressing the handle portion 12 provided with electrical parts against the connecting base 26 provided with the electrical part, or pressing the connecting base 38 against the connecting wall portion 33*f* provided with the electrical part. However, electrical connection according to the third embodiment of the present invention is achieved by connector mating. Descriptions of the same structure or method will be omitted therefore.

Figure 13:
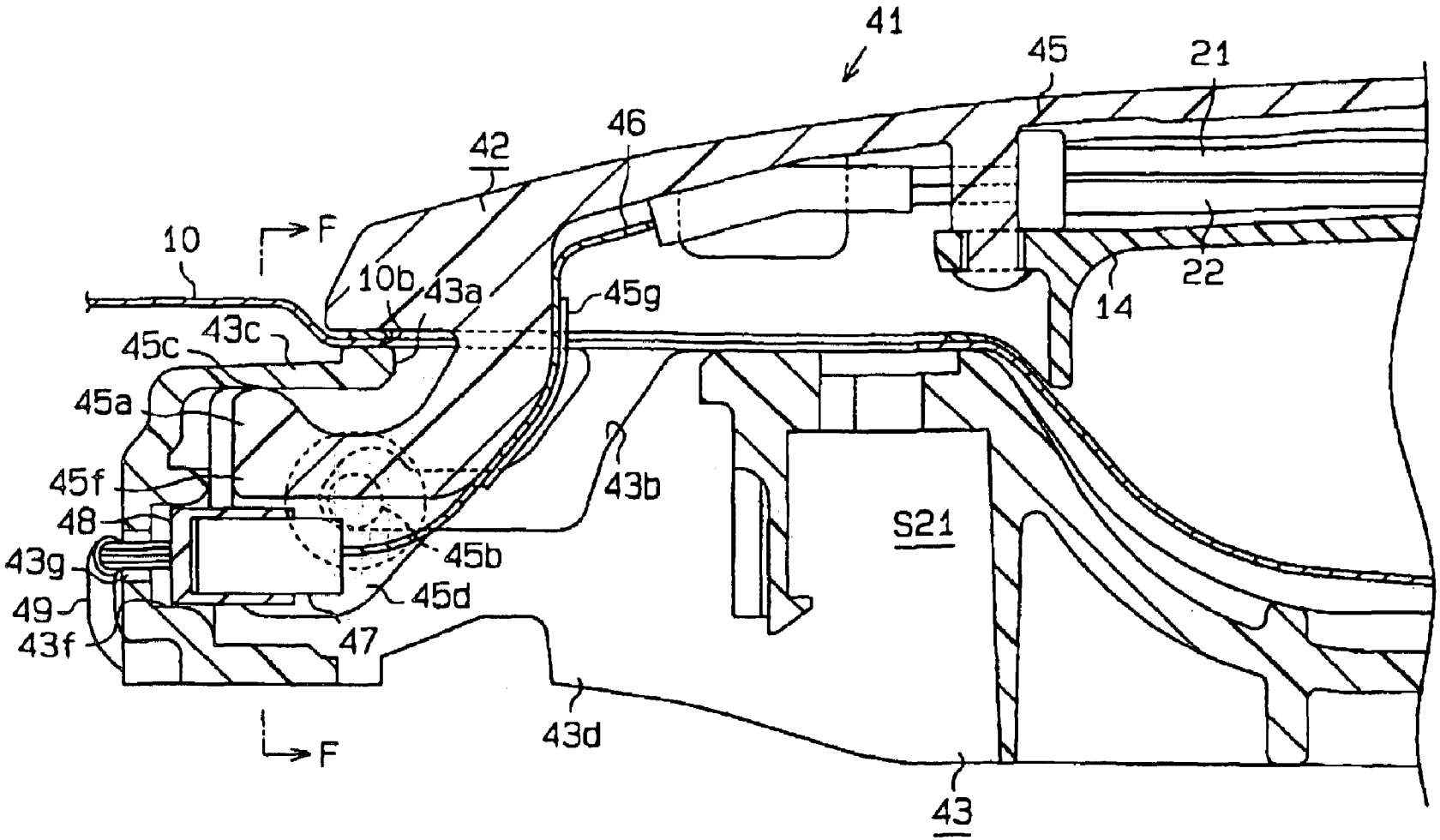
FIG. 13 is a cross sectional view illustrating an outside handle according to a third embodiment of the present invention.

As illustrated in FIG. 13, an outside handle 41 includes a handle portion 42 and a handle frame 43. The handle portion 42 is arranged on the exterior side of the door outer panel 10 while the handle frame 43 is arranged on the interior side of the door outer panel 10. The handle frame 43 is fixed to the door outer panel 10 in the same manner as the first and second embodiments of the present invention. The handle portion 42 is mounted on the handle frame 43, with the door outer panel 10 interposed between the handle portion 42 and the handle frame 43. The handle portion 42 can be rotated relative to the handle frame 43 within a predetermined rotational range.

The handle frame 43 can be made of resin material and is defined to have an approximately rectangular cylindrical shape with a seating rim. The handle frame 43 includes a frame-side handle inserting opening 43*a* at a portion corresponding to the panel-side handle inserting opening 10*b*. The handle frame 43 defines a first inner space S21 corresponding to the frame-side handle inserting opening 43*a*.

In the meantime, the handle portion 42 includes the handle base 14 and a handle cover 45, both of which can be resin made. The handle cover 45 is integrally provided with a hinge arm portion 45*a* at one side thereof, i.e., at a vehicle forward side illustrated at left side in FIG. 13.

Figure 14:
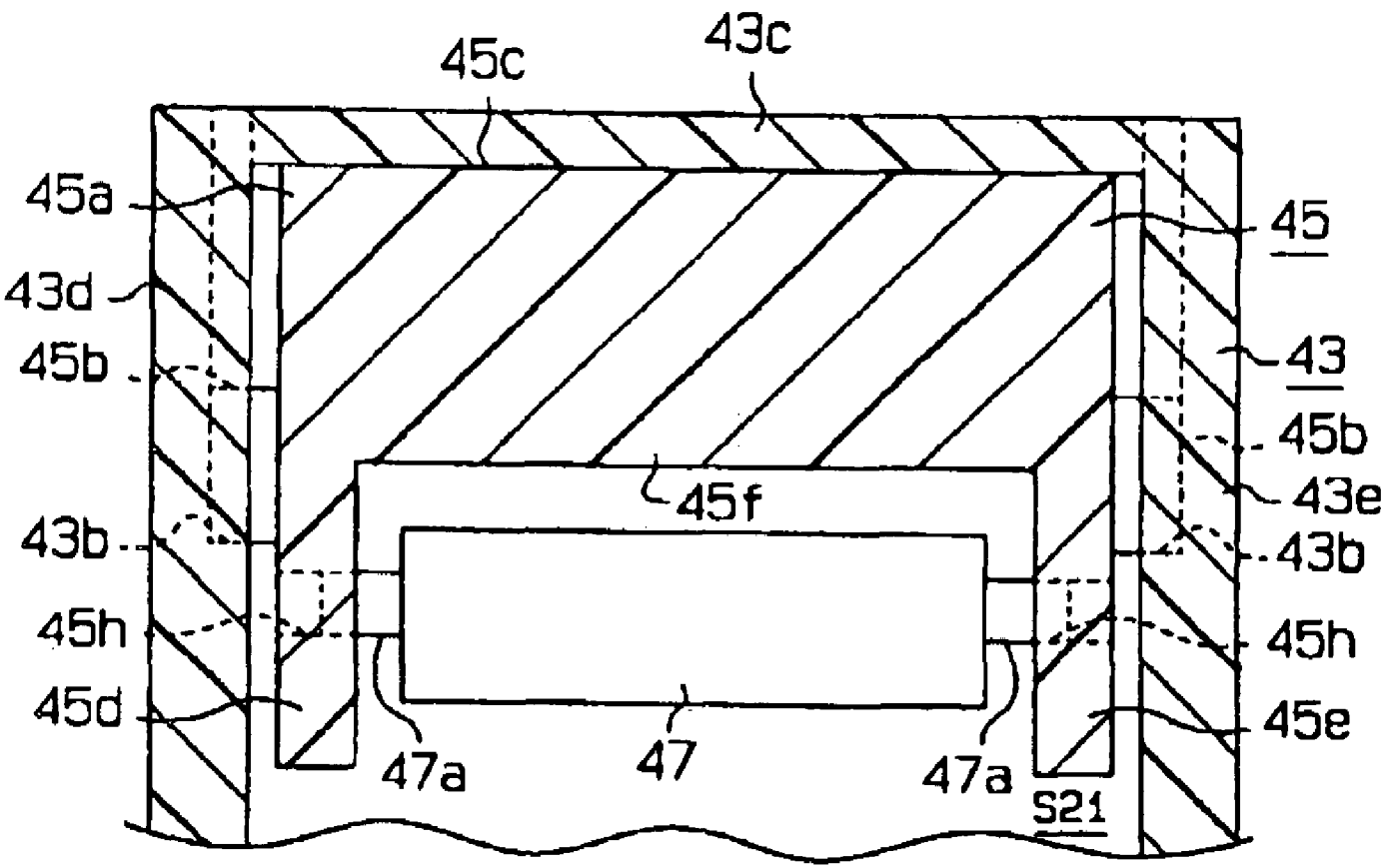
FIG. 14 is a cross sectional view taken along a line F—F in FIG. 13.

The hinge arm portion 45*a* is inserted into the handle inserting opening 10*b* and the frame-side handle inserting opening 43*a*. More particularly, as illustrated in FIG. 14, the handle frame 43 includes side wall portions 43*d* and 43*e* which define the first inner space S21. Each side wall portion 43*d* and 43*e* has a guiding groove 43*b* recessed along assembling process of the hinge arm portion 45*a*, i.e., along assembling process of the handle portion 42. As also illustrated in FIG. 13, each guiding groove 43*b* extends from the frame-side handle inserting openings 43*a* towards a bottom side of the handle frame 43, i.e., towards a bottom side in FIG. 13. A tip end of each guiding groove 43*b* is bent along a longitudinal direction of the side wall portions 43*d* and 43*e*, i.e., towards a vehicle forward. In the meantime, the hinge arm portion 45*a* includes side wall portions 45*d* and 45*e*, both of which extend towards the bottom side of the handle frame 43, and a lid portion 45*f* connecting the side wall portions 45*d* and 45*e*. Each side wall portion 45*d* and 45*e* is provided with a projection 45*b* projecting from an approximately intermediate portion thereof towards the facing side wall. As described later, the handle portion 42 is inserted along the guiding grooves 43*b*, i.e. the assembling process of the handle portion 42 when the projections 45*b* are engaged to the guiding grooves 43*b*. The handle portion 42, i.e., the handle cover 45, can be linked to the handle frame 43 and can be rotated relative thereto with a fulcrum of a contact portion between a projection 45*c* defined at a tip end portion of the handle portion 42 and the lid portion 43*c* of the handle frame 43.

According to the third embodiment of the present invention, the respective electrical signal wires of the transmitting antenna 21, the door unlocking sensor 22, and the door locking switch 23 meet together and are connected to a single flexible flat cable 46, i.e., an FFC 46 which is arranged at a side of the hinge arm portion 45*a*. The FFC 46 defines an electrical signal wire at the side of the handle portion 42 and is guided out along the hinge arm portion 45*a*. The FFC 46 can be electrically connected to an electrical signal wire at a side of the vehicle, i.e., at a side of the handle frame 43.

The following description describes one example of electrically connected conditions between the FFC 46 and the vehicle, i.e., the handle frame 43. The hinge arm portion 45*a* includes a guiding claw 45*g* projecting towards the right side in FIG. 13, i.e. projecting approximately in parallel with a portion of the hinge arm portion 45*a*. The portion of the hinge arm portion 45*a* faces towards the vehicle rearward. The FFC 46 is guided out along the hinge arm portion 45*a* with both sides thereof supported by the guiding claw 45*g*.

As illustrated in FIG. 14, bearing portions 45*h* are defined in portions of the side wall portions 45*d* and 45*e* near the projections 45*b*. Each bearing portion 45*h* penetrate each side wall portion 45*d* and 45*e* in a width direction thereof. The hinge arm portion 45*a* supports an approximately block-shaped or rectangular-shaped connector 47 (i.e. a first electrical portion) which can be molded with a resin material. That is, a tip end side of the connector 47 (i.e. a handle-side connected portion) is integrally provided with shaft portions 47*a* projecting outwardly corresponding to the bearing portions 45*h*. The connector 47 can be rotatably linked to the hinge arm portion 45*a* when the shaft portions 47*a* are inserted into the bearing portions 45*h*. Further, respective branched leads of the FFC 46 are housed in the connector 47.

As illustrated in FIG. 13, the connector 47 is mated with a connector holder 48 (i.e. a frame-side connected portion, a second electrical portion) of which inner diameter is substantially the same as an outer diameter of the connector 47. The connector holder 48 is an approximately rectangular shaped structure with at least one bottom. The connector holder 48 is provided with terminals which can be electrically connected to the respective leads housed in the connector 47. Each terminal of the connector holder 48 can be reliably electrically connected to each lead when the connector 47 is mated with the connector holder 48. Each terminal of the connector holder 48 can be electrically connected to electrical signal wires at a vehicle side via a cable 49.

The connector holder 48 is fitted into a recessed portion 43*f* with an approximately cylindrical structure having at least one bottom. A clearance is provided between the holder 48 and the recessed portion 43*f* to allow movement of the former in the latter. The recessed portion 43*f* is defined at a wall surface of the handle frame 45 facing the hinge arm portion 45*a*. Therefore, the connector holder 48 mated with the connector 47 can be oscillated relative to the handle frame 43. Further, the connector holder 48 and the connector 47 can be rotated relative to the hinge arm portion 45*a*. Still further, the cable 49 is inserted into an inserting bore 43*g* penetrating an approximately central portion of the recessed portion 43*f* such that the cable 49 can be electrically connected to each terminal of the connector holder 48.

Figure 15:
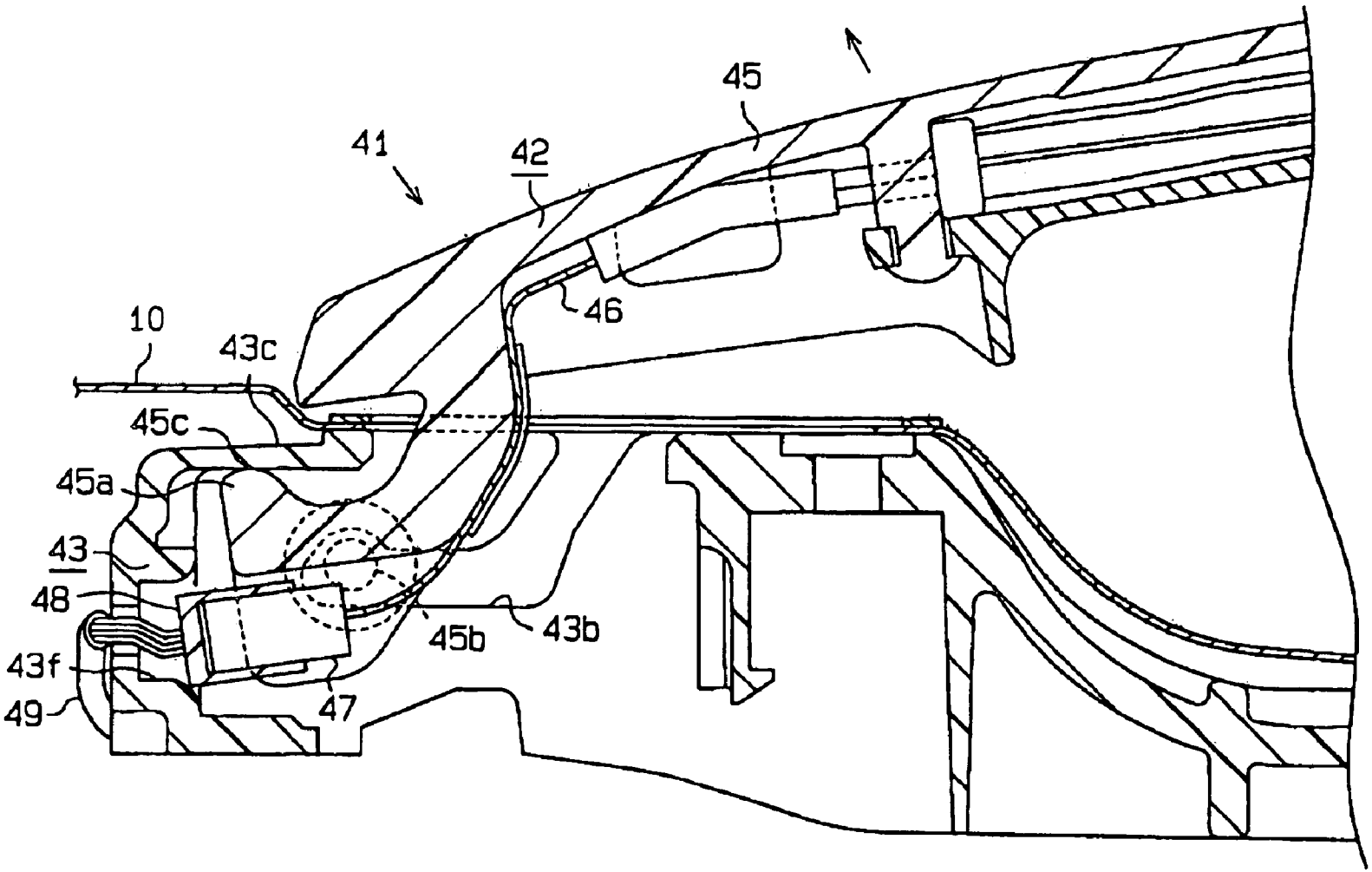
FIG. 15 is a cross sectional view illustrating a condition of a handle portion rotated at a maximum rotating amount within an allowable range according to the third embodiment.

When the handle portion 42 is rotated from a normal condition with no applied load in FIG. 13 to a full-stroke condition illustrated in FIG. 15, in which-the handle portion 42 was rotated at a maximum rotation angle within the allowable range, the connector 47 and the connector holder 48 can be moved or pivoted relative to the handle frame 43, and can be rotated relative to the hinge arm portion 45*a*. Therefore, the connector 47 and the connector holder 48 are not be interfered by the handle frame 43 in response to the rotation of the handle portion 42 such that the electrical connection can be still maintained. Further, the cable 49 at the vehicle side can be reliably connected to the FFC 46 at the handle side via the connector 47 and the connector holder 48. When the handle portion 42 is returned from the full stroke condition to the normal condition illustrated in FIG. 13, the above electrical connection can be achieved in the same manner.

Figure 16:
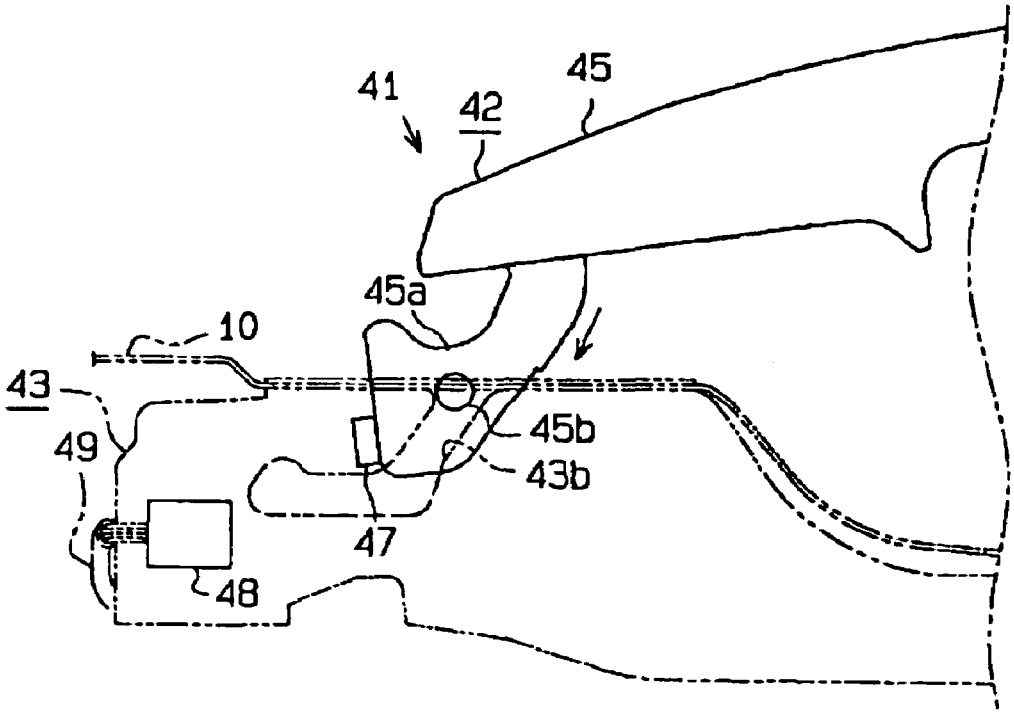
FIG. 16 is a view schematically illustrating a condition for assembling the handle portion according to the third embodiment.
Figure 19:
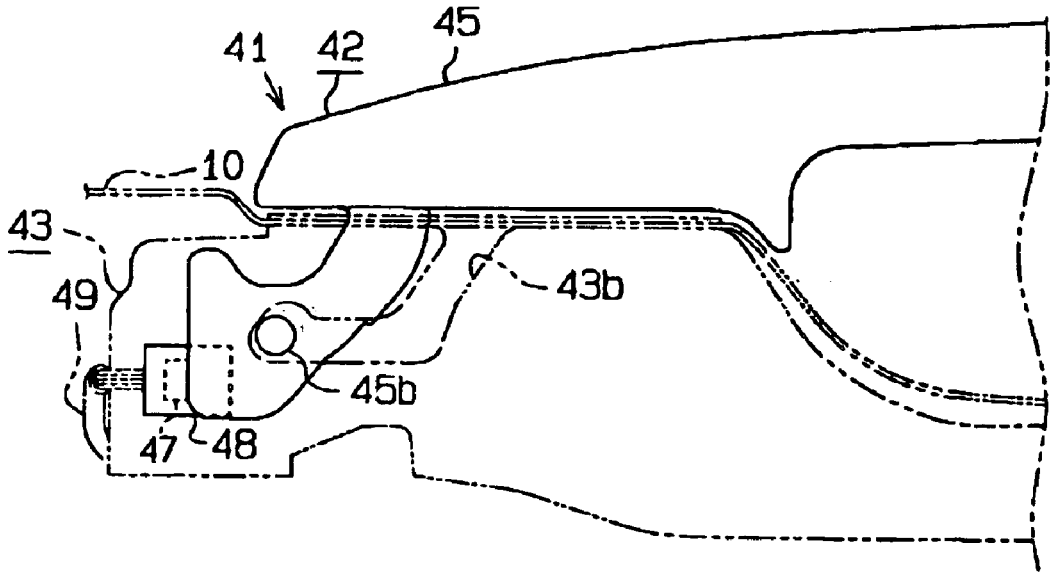
FIG. 19 is still further another view schematically illustrating a condition for assembling the handle portion according to the third embodiment.

The following description will describe an example of methods of assembling the handle portion 42 to the handle frame 43 with reference to FIGS. 16 and 19. As illustrated in FIG. 16, when the handle portion 42 is assembled, the connector holder 48 is temporarily set at a predetermined position so as to be idly fitted into the recessed portion 43*f*. In the meantime, a tip end of the connector 47 is temporarily fixed at a predetermined position projected from a tip end of the hinge arm portion 45. The connector 47 can be temporarily supported by friction force between the bearing portions 45*h* and the shaft portions 47*a*, as illustrated in FIG. 14. Under the aforementioned condition, the projection 45*b* of the hinge arm portion 45*a* is positioned in the guiding groove 43*b*.

Figure 17:
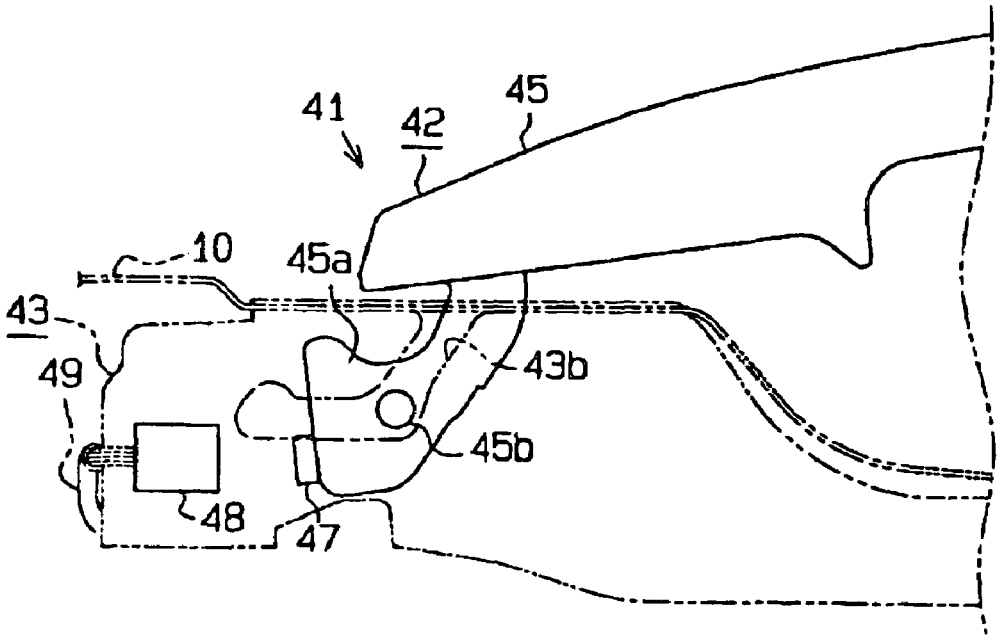
FIG. 17 is another view schematically illustrating a condition for assembling the handle portion according to the third embodiment.
Figure 18:
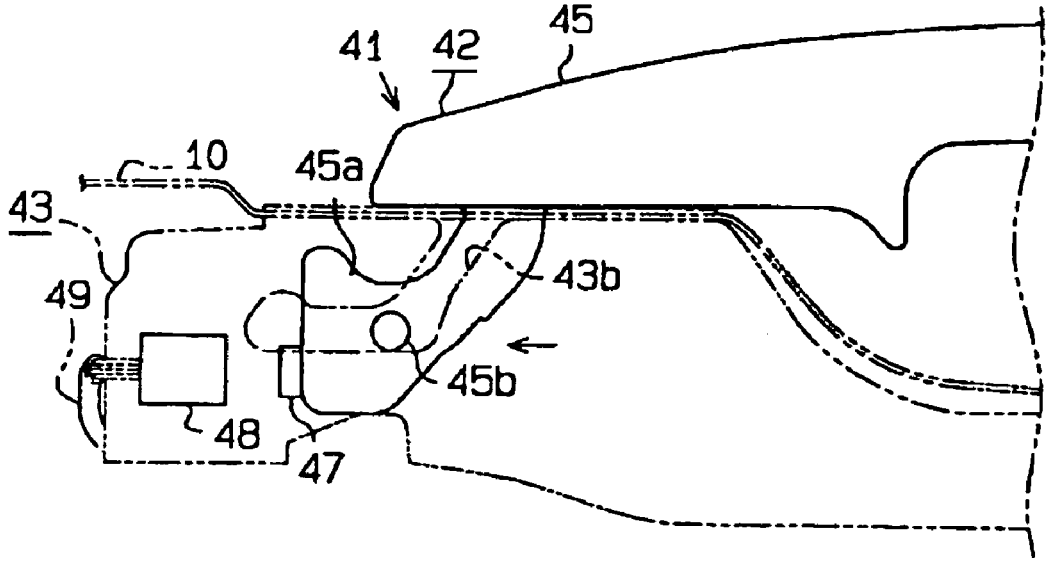
FIG. 18 is further another view schematically illustrating a condition for assembling the handle portion according to the third embodiment.

As illustrated in FIG. 17, the handle portion 42 is then shifted toward a tip end side of the guiding groove 43*b* along the guiding groove 43*b* with the projection 45*b* engaged with the guiding groove 43*b*. The whole hinge arm portion 45*a* can be inserted in to the handle frame 43, i.e., into the first inner space S21 through the handle inserting openings 10*b* and 43*a*. In this case, the stroke arm portion 15*b* can be inserted into the handle frame 43 through the handle inserting openings 10*c* and 13*b*. As illustrated in FIG. 18, in response to further movement of the handle portion 42, the projection 45*b* is arranged at the base end side of the guiding groove 43*b* bent in the longitudinal direction of the side wall portions 43*d* and 43*e*, i.e. in a direction of a vehicle forward. At this point, the connector 47 and the connector holder 48 are arranged to be substantially coaxial. As illustrated in FIG. 19, the handle portion 42 is then moved towards the tip end side along the guiding groove 43*b* with the projection 45*b* engaged with the guiding groove 43*b*. The hinge arm portion 45*a* is then inserted towards the lid portion 43*c*. The connector 47 and the connector holder 48 are restrained from being moved in the axial direction by the recessed portion 43*f* such that the connector 47 and the connector holder 48 can be mated. Therefore, the connector 47 can be electrically connected to the holder 48. That is, the hinge arm portion 45*a* and the stroke arm portion 15*b* are inserted through the frame-side handle inserting openings when the handle portion 42 is moved with the projection 45*b* engaged with the guiding groove 43*b*. Further, when the projection 45*b* is engaged with the guiding groove 43*b*, the assembling direction of the hinge arm portion 45*a* corresponds to the axial direction of the connector 47 and the holder 48 mated with the connector 47.

As described above, according to the third embodiment of the present invention, following effects can be exerted.

(1) When the handle portion 42 is supported by the handle frame 43, the projection 45*b* is engaged to the guiding groove 43*b*. Therefore, assembling track of the hinge arm portion 45*a* can be restrained. That is, the hinge arm portion 45*a* can be assembled to the handle frame 43 along the assembling track thereof, thereby enabling to smoothly support the handle portion 42 at a normal position (i.e. at a predetermined position) of the handle frame 43. Further, the handle portion 42 can be prevented from being displaced form the normal position. Therefore, displacement between the handle portion 42 and the handle frame 43 can be reduced, thereby enabling to enhance operating feeling.

(2) The assembling track of the binge arm portion 45*a* can be restrained by an easy way which uses the guiding groove 43*b* and the projection 45*b*.

(3) The hinge arm portion 45*a* can be assembled to the handle frame 43 along the assembling track thereof. Therefore, the connector 47 can be smoothly connected to the connector holder 48. The electrical connection therebetween can be then performed. Further, the connector 47 is arranged at the hinge arm portion 45*a* to be moved or rotated. That is, the connector 47 is supported by the side wall portions 45*d* and 45*e* of the hinge arm portion 45*a*. Therefore, the connector 47 can be mated with the holder 48, absorbing manufacturing fluctuation or assembling fluctuation. According to the third embodiment of the present invention, the assembling track of the hinge arm portion 45*a* includes two assembling directions. However, the assembling track won't fluctuate so as to assemble the hinge arm portion 45*a* properly.

(4) The connector 47 is surrounded by an inner wall surface of the hinge arm portion 45*a*. The inner wall surface has a reverse C shaped cross section having the side wall portions 45*d*, 45*e*, and the lid portion 45*f*. The connector 47 are provided at the hinge arm portion 45*a* with the shaft portions 47*a* not projecting from an outer shape of the hinge arm portion 45*a*. Therefore, when the hinge arm portion 45*a* is assembled, the connector 47 is not interfered with other components such as the door outer panel 10, thereby enabling to avoid loosing electrical performance.

(5) The connector 47 is disposed at the hinge arm portion 45*a* to be moved or rotated. Therefore, when the handle portion 42 is assembled or supported by the handle frame 43, the connector 47 is mated with the holder 48 after being shifted within the above oscillating range. In this way, the electrical connection therebetween can be performed. Further, assembling performance of the handle portion 42 to the handle frame 43 can be enhanced. Still further, even if the handle portion 42 is a movable type, the electrical connection between the connector 47 and the holder 48 can be maintained within the above oscillating range, thereby enhancing versatility of the handle portion 42.

Figure 20:
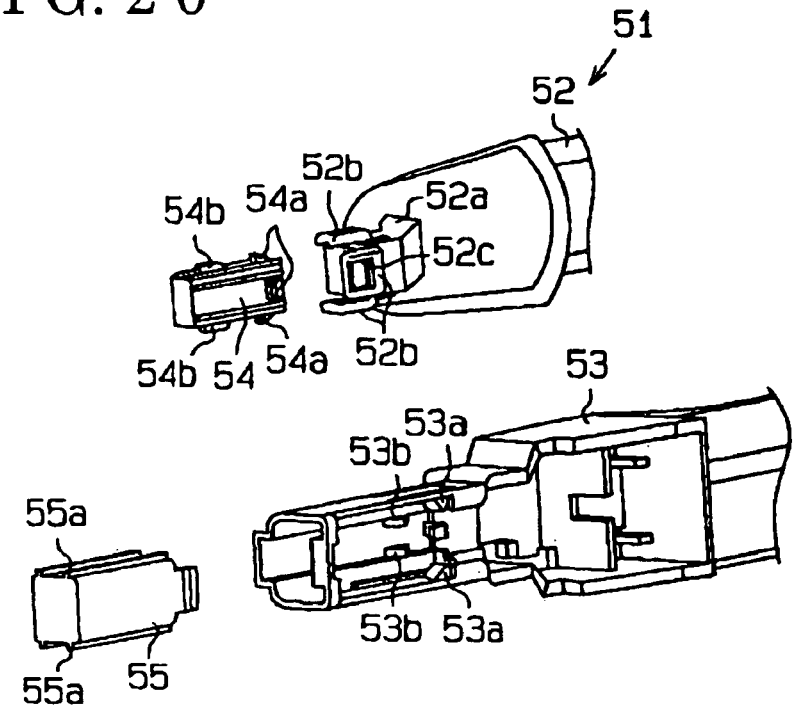
FIG. 20 is an exploded view illustrating an outside handle according to a fourth embodiment of the present invention.

An exploded view of an outside handle in FIG. 20 according to a fourth embodiment of the present invention is viewed from a vehicle inside. An up and down direction in FIG. 20 corresponds to a vehicle vertical direction. An outside handle 51 includes a handle portion 52 and a handle frame 53. A connector 54 (i.e. a handle-side connected portion, a first electrical portion) is supported by a hinge arm portion 52*a* of the handle portion 52 so as to be moved or rotated in the up and down direction and in the right and left direction. A connector holder 55 (i.e. a frame-side connected portion, a second electrical portion) is supported by the handle frame 53. The connector 54 is electrically connected to an electrical signal wire at a side of the handle portion 52. In the meantime, the connector holder 55 is electrically connected to electrical signal wires at a vehicle side.

More particularly, the hinge arm portion 52*a* is provided with plural supporting wall portions 52*b* projecting from side surfaces except for a vehicle outer side. According to the fourth embodiment of the present invention, the hinge arm port ion 52*a* is provided with the at least three supporting wall portions 52*b*. The supporting wall portions 52*b* is provided with an engaging bore 52*c* having an opening in an approximately square shaped structure. In the meantime, the connector 54 is provided with plural engaging claws 54*a* projecting corresponding to the supporting wall portions 52*b* around a rear end portion of the connector 54. According to the fourth embodiment of the present invention, the connector 54 is provided with the at least three engaging claws 54*a*. Each engaging claw 54*a* has a smaller size than the engaging bore 52*c*, wherein each engaging claw 54*a* is not disengaged from an inner wall surface of the engaging bore 52*c*. Therefore, the connector 54 is approximately integrally supported by the hinge arm portion 52*a* with the engaging claws 54*a* engaged with the engaging bore 52*c* and can be moved or pivoted relative thereto. Especially, the vehicle outer side has been released. Therefore, the rotation of the connector 54 is limited to a predetermined range. When the handle portion 52 is assembled or detached, the hinge arm portion 52*a* and the connector 54 cannot be separated.

The connector 54 is further provided with projections 54*b* (i.e. means for allowing) projecting at a front end side of the connector 54. The projections 54*b* are defined at upper and down side surfaces in FIG. 20. The projections 54*b* control engagement between the handle frame 53 and the connector holder 55. The connector 54 is further provided with an engaging claw 54*c* projecting at the vehicle outer side surface, i.e. at a side surface at an upper side in FIG. 22. As described later, the engaging claw 54*c* links the connector 54 and the connector holder 55.

The handle frame 53 is provided with an engaging portion for engaging the handle frame 53 with the handle portion 52 in the same manner as the first, second, and third embodiments. The handle frame 53 is further provided with a structure for housing the connector holder 55 of which vehicle inside opens in the lateral direction. More particularly, the handle frame 53 is provided with engaging claws 53*a*, i.e. means for engaging, projecting to each other. The engaging claws 53*a* correspond to the projections 54*b* of the connector 54. The front end side of the handle frame 53 near or at the engaging claws 53*a* is notched in a longitudinal direction towards the vehicle forward. Therefore, the handle frame 53 can be expanded in response to flexure. In the meantime, the connector holder 55 is provided with engaging bores 55*a* corresponding to the engaging claws 53*a*. The connector holder 55 is approximately integrally assembled at the handle frame 53 and is supported thereby with the inner wall surfaces of the engaging bores 55*a* engaged with the engaging claws 53*a* when the connector 54 is mated with the connector holder 55, the engaging claws 53*a* are expanded by the projections 54*b*. Therefore, the engaged condition between the handle frame 53 and the connector holder 55 is released.

The handle frame 53 is provided with projections 53*b* projecting at the vehicle inside corresponding to the engaging claw 54*c*. The connector holder 55 is provided with a lock 55*b* outwardly projecting at the vehicle outside at the rear end portion. The lock 55*b* corresponds to the projections 53*b*, i.e. the engaging claw 54*c*. The connector holder 55 is linked with the connector 54 with the engaging claw 54*c* engaged with the lock 55*b*. When the connector holder 55 has not been engaged with the handle frame 53, the connector holder 55 can be slidably moved in the handle frame 53 within a range in which the lock 55*b* comes in contact with the projection 53*b*.

Figure 22B:
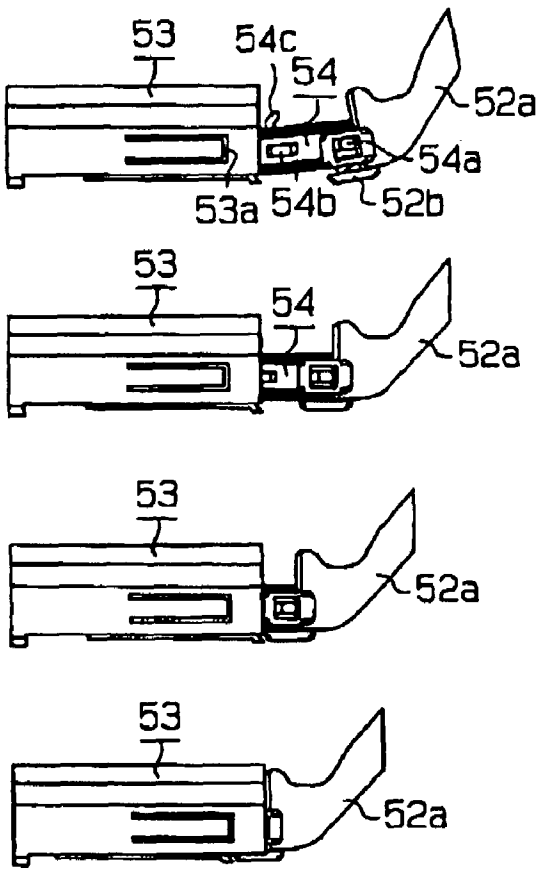
FIG. 22(*a*) is a process drawing for explaining a process for assembling a connector provided at a hinge arm portion of the handle portion to a connector holder according to the fourth embodiment of the present invention.
Figure 22A:
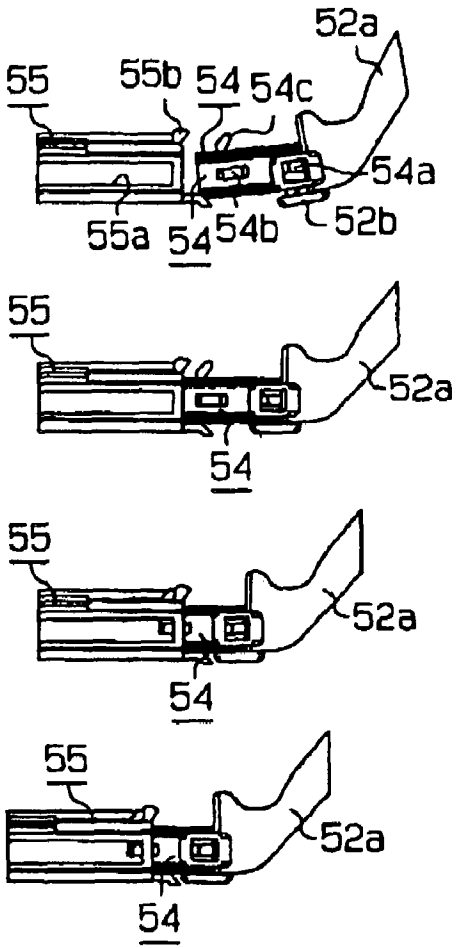

As illustrated in FIGS. 22(*a*) and (*b*), first of all, the connector 54 is inserted into or mated with the connector holder 55. At this point, the connector holder 55 is engaged with the handle frame 53 by the engaging claws 53*a*. Therefore, the connector 54 is inserted into the connector holder 55 fixed to the handle frame 53. As described above, the connector 54 has been linked to the hinge arm portion 52*a* so as to be moved or pivoted relative thereto. Therefore, the connector 54 can be smoothly inserted into the connector holder 55 without undesired interference therebetween. The connecter 54 is gradually inserted into the connector holder 55 as illustrated in FIG. 22(*b*). The connector 54 is completely mated with the holder 55 wit the engaging claw 54*c* engaged with the lock 55*b*. In this case, the electrical signal wires at the handle side can be electrically connected to the electrical signal wires at the vehicle side vie the connector 54 and the connector holder 55. In response to further movement of the connector 54, the engaging claws 53*a* are expanded by the projection 54*b*, wherein the handle frame 53 is disengaged from the connector holder 55. The connector 54 is slidably moved in the handle frame 53 with the connector holder 55 within the range in which the lock 55*b* comes in contact with the projections 53*b* of the handle frame 53. The hinge arm portion 52*a* is hence positioned at a predetermined position of the handle frame 53, i.e. at a normal position. In other words, the assembling position of the handle frame 53 is determined by the position of the projections 53*b*.

Figure 21A:
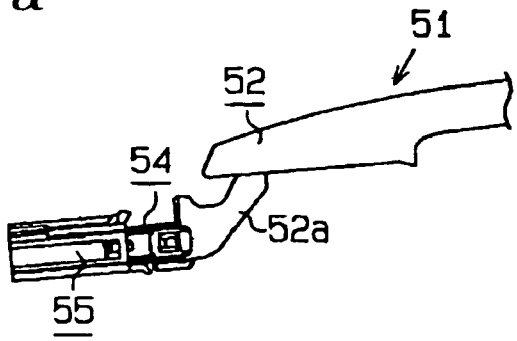
FIG. 21(*a*) is a schematic view for explaining a; full stroke condition of a handle portion rotated within an allowable range according to the fourth embodiment.
Figure 21B:
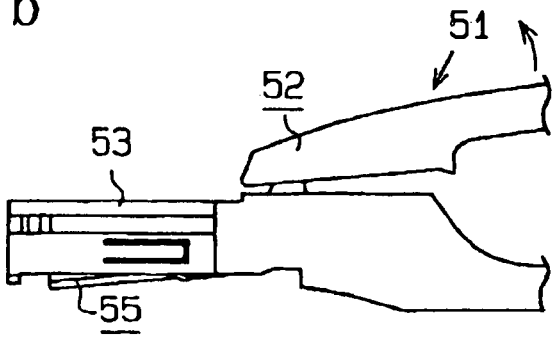

The hinge arm portion 52*a* arranged at the normal position can be linked to the handle frame 53 and can be rotated relative thereto within a predetermined range about a rotation center in the same manner as the first, second, and third embodiments. As illustrated in FIG. 21(*a*), when the handle portion 52 is rotated from a normal condition illustrated at a lowermost row in FIG. 22(*a*) to a full stroke condition, in which the handle portion 52 is rotated within the allowable range, the connector 54 provided at the hinge arm portion 52*a* is integrally rotated with the connector holder 55. In this case, as illustrated in FIG. 21(*b*), the connector 54 and the connector holder 55 are not interfered with the handle frame 53, since the vehicle inside of the handle frame 53 is opened.

As described above, according to the fourth embodiment of the present invention, following effects can be executed as non-limiting examples.

(1) The connector 54 is provided with the projections 54*b*. The projections 54*b* allow the handle portion 52 to be arranged at the normal position by disengaging the connector holder 55 from the connector frame 53 after completely mating the connector 54 into the connector holder 55. Therefore, the handle portion 52 is arranged at the normal position under the condition that the connector 54 has been electrically connected to the holder 55. In this case, the handle portion 52 can be prevented from being assembled during the electrical connection defect. That is; an assembling stroke of the hinge arm portion 52*a* to be positioned at the normal position is set to be greater than a connecting stroke thereof for completely mating the connector 54 with the connector holder 55. Therefore, the handle portion 52 can be assembled at the normal position after completely mating the connector 54 with the connector holder 55. In accordance with a relationship between the projections 53*b* and the lock 55*b*, the connector holder 55 has been supported by the engaging claws 53*a* and can not be moved until when the connector 54 is completely mated with the connector holder 55. The connector holder 55 can be moved with the engaging claws 53*a* disengaged by the projections 54*b* after the complete connection between the connector 54 and the holder 55. That is, in order to assemble the handle portion 52 at the normal position, the connector 54 has to be completely mated with the connector holder 55. When the complete mating has not been achieved for some reasons, the handle portion 52 can not be assembled at the normal position, i.e. at a predetermined position. Therefore, the mating defect can be found easily. In other words, when the handle portion 52 has been completely assembled to the handle frame 53, the connector 54 can be completely mated with the connector holder 55, thereby leading to complete electrical connection. Further, assembling fluctuation and fluctuation of components in a vehicle longitudinal direction can be absorbed by adjusting a difference between the connecting stroke and the assembling stroke.

(2) The connector 54 is supported at the hinge arm portion 52*a* so as to be moved or rotated in the up and down direction and in the right and left direction. Therefore, assembling fluctuation, fluctuation of the components in a vehicle vertical direction, and fluctuation thereof in the vehicle lateral direction can be effectively absorbed.

(3) The vehicle inside of the handle frame 53 is opened in the lateral direction. Therefore, the connector 54 and the holder 55 can be moved or pivoted in response to the rotation of the handle portion 52 without being interfered with the handle frame 53. Especially, a contact portion between the connector 54 and the connector holder 55 is not moved. Therefore, reliability for electrical connection can be assured.

The present invention is not limited to the above described embodiments, and can be modified as described below.

According to the first embodiment of the present invention, the engaging members 15*g* are provided at the hinge arm portion 15*a*. Alternatively, the engaging members 15*g* can be provided at the connecting base 26.

According to the second embodiment of the present invention, the engaging members 38*h* are provided at the connecting base 38. Alternatively, the engaging units 38*h* can be provided at the handle frame 33, i.e. at the engaging wall portion 33*g*.

According to the first and second embodiments of the present invention, the torsion coil springs 25 and 37 are employed as the means for biasing. Alternatively, a leaf spring or a rubber can be employed as the biasing means.

According to the first and second embodiments of the present invention, each signal wire at the handle and vehicle sides are the FFC. Alternatively, the signal wire can be represented by a Flexible Printed circuit substrate (i.e. an FPC) or a Conductive Ink Circuitry (i.e. a CIC).

According to the third embodiment of the present invention, the projections 45*b* are provided at the hinge arm portion 45*a*, and the guiding grooves 43*b* are provided at the handle frame 43. However, these relationships can be reverse.

According to each embodiment, electrical components housed in the handle portion can be altered in response to door opening/closing function as needed. That is, the electrical components can be altered in response to a system such as an E-latch system and a smart entry system as non-limiting examples.

According to each embodiment, the handle portion is a movable type. However, the handle portion can be a fixed type.

The principles, embodiments and modes of operation of the present invention have been described in the foregoing specification and drawings. However, the invention which is intended to be protected is not to be construed as limited to the particular embodiments disclosed. Further, the embodiments described herein are to be regarded as illustrative rather than restrictive. Plural objectives are achieved by the present invention, and yet there is usefulness in the present invention as far as one of the objectives are achieved. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicle door outside handle apparatus comprising:

a handle frame fixed to a vehicle door;

a handle portion supported on the handle frame to be accessible from an outside of the vehicle door;

at least one electrical component housed in the handle portion;

a handle-side connected portion provided at the handle portion and electrically connected to the at least one electrical component housed in the handle portion;

a frame-side connected portion provided at the handle frame, the frame-side connected portion being adapted to be engaged with the handle-side connected portion, and the frame-side connected portion being electrically connected with the handle-side connected portion;

wherein the frame-side connected portion is adapted to come in contact with the handle-side connected portion to pivot the frame-side connected portion, wherein the electrical connection between the handle-side connected portion and the frame-side connected portion is achieved;

wherein the handle-side connected portion includes at least one first lead and the frame-side connected portion includes at least one second lead, the at least one first lead of the handle-side connected portion engaged with the at least one second lead of the frame-side connected portion to provide the electrical connection; and means for applying a biasing force to the frame-side connected portion to urge the frame-side connected portion toward the handle-side connected portion to electrically connect the frame-side connected portion with the handle-side connected portion.

2. The outside handle apparatus according to claim 1, wherein the means for biasing is provided at the handle frame and includes at least one of a torsion spring, a leaf spring, and a rubber.

3. An outside handle apparatus comprising:

a handle frame fixed to a vehicle door;

a handle portion supported on the handle frame to be accessible from an outside of the vehicle door;

at least one electrical component housed in the handle portion;

a handle-side connected portion provided at the handle portion and electrically connected to the at least one electrical component housed in the handle portion;

a frame-side connected portion provided at the handle frame;

the handle-side connected portion being adapted to be engaged with the frame-side connected portion, and the handle-side connected portion being electrically connected with the frame-side connected portion;

wherein the handle-side connected portion is adapted to come in contact with the frame-side connected portion to pivot the handle-side connected portion, wherein the electrical connection between the handle-side connected portion and the frame-side connected portion is achieved;

wherein the handle-side connected portion includes at least one first lead and the frame-side connected portion includes at least one second lead, the at least one first lead of the handle-side connected portion engaged with the at least one second lead of the frame-side connected portion to achieve the electrical connection; and means for applying a biasing force to the handle-side connected portion to urge the handle-side connected portion toward the frame-side connected portion to electrically connect the handle-side connected portion with the frame-side connected portion.

4. The outside handle apparatus according to claim 3, wherein the means for biasing is provided at the handle portion and includes at least one of a torsion spring, a leaf spring, and a rubber.

5. The outside handle apparatus according to claim 3, wherein the handle-side connected portion and the frame-side connected portion are electrically connected when the handle-side connected portion is mated with the frame-side connected portion.

6. The outside handle apparatus according to claim 5, wherein the handle frame includes means for engaging the frame-side connected portion, and the handle-side connected portion includes means for allowing the handle portion to be assembled at a predetermined position after completely mating the handle-side connected portion with the frame-side connected portion.

7. The outside handle apparatus according to claim 6, wherein the means for allowing the handle portion to be assembled at the predetermined position releases the engaged condition of the frame-side connected portion engaged by the means for engaging.

8. The outside handle apparatus according to claim 6, wherein the handle-side connected portion of the handle portion is a connector, and the frame-side connected portion of the handle frame is a connector holder, the connector being engaged with the connector holder to provide the electrical connection.

9. The outside handle apparatus according to claim 5, wherein the handle-side connected portion of the handle portion is a connector, and the frame-side connected portion of the handle frame is a connector holder, the connector being engaged with the connector holder to provide the electrical connection.

* * * * *